US007448176B2

(12) United States Patent
Drake

(10) Patent No.: US 7,448,176 B2
(45) **Date of Patent: *Nov. 11, 2008**

(54) APPARATUS AND SYSTEM FOR CONCRETE SURFACE REPAIR AND METHOD

(76) Inventor: William M. Drake, P.O. Box 2380, Marysville, CA (US) 95901

( * ) Notice: Subject to any disclaimer, the term of this patent is extended or adjusted under 35 U.S.C. 154(b) by 924 days.

This patent is subject to a terminal disclaimer.

(21) Appl. No.: 10/823,438

(22) Filed: Apr. 12, 2004

(65) Prior Publication Data

US 2004/0200173 A1 Oct. 14, 2004

Related U.S. Application Data

(60) Provisional application No. 60/462,798, filed on Apr. 14, 2003.

(51) Int. Cl.
*E04F 15/22* (2006.01)

(52) U.S. Cl. ..... 52/396.08; 52/514; 404/73; 404/34

(58) Field of Classification Search ..... 404/73, 404/75, 78, 84.05, 34, 35, 36; 52/396.08, 52/514, 514.5
See application file for complete search history.

(56) References Cited

U.S. PATENT DOCUMENTS

| | | | | |
|---|---|---|---|---|
| 4,320,985 | A * | 3/1982 | Kleinemas | 404/99 |
| 5,476,340 | A * | 12/1995 | Contrasto | 404/75 |
| 6,047,227 | A * | 4/2000 | Henderson et al. | 701/50 |
| 6,752,566 | B2 * | 6/2004 | Smith | 404/75 |
| 6,976,804 | B1 * | 12/2005 | Asplin | 404/78 |
| 7,144,191 | B2 * | 12/2006 | Kieranen et al. | 404/84.1 |

* cited by examiner

*Primary Examiner*—Basil Katcheves
(74) *Attorney, Agent, or Firm*—Charles L. Thoeming

(57) ABSTRACT

System and apparatus for repair of concrete surfaces, and a method of using the same, having slab removal plates, slab replacement plates, slab transport/replacement frame carrier vehicles, slab injection/guide collars for application of fluid binding material as support for the replacement slabs, and microprocessor controlled global satellite coordinates, wireless transmission, and bar code identification for slab replacement.

57 Claims, 11 Drawing Sheets

APPARATUS AND SYSTEM FOR CONCRETE SURFACE REPAIR AND METHOD

CROSS-REFERENCES TO RELATED APPLICATIONS

This U.S. non-provisional patent application is based upon and claims the filing date of U.S. provisional patent application Ser. No. 60/462,798 filed Apr. 14, 2003.

STATEMENT REGARDING FEDERALLY SPONSORED RESEARCH OR DEVELOPMENT

None.

REFERENCE TO A MICRO-FICHE APPENDIX

None.

BACKGROUND OF THE INVENTION

1. Field of the Invention

The present invention relates to an improved apparatus and system, and methods for use of the same, for quick and cost effective, non-impact removal of failed concrete surfaces, and replacement of the failed sections using embodiments of suspension bridge-plates, carriers, and guide/grout injection collars to repair damaged highways built of concrete slabs or pre-cast concrete slabs.

Using the system of plates and carrier of the present invention, a crew of possibly as few as two individuals could quickly and safely remove damaged slabs and replace the removed slabs with new, pre-cast concrete slabs. Importantly, by virtue of equipment designed for this operation specifically, this system addresses the entire operation much faster than the art. The system, apparatus, and methods of the present invention provide precision location and alignment for replacement slabs, as well as a more uniform density and distribution of underlying substrate fluid binding materials for support of the replacement slabs. Highway downtime for these heretofore complicated repair procedures is lessened by the present invention, minimizing traffic driver frustration and negative impact on local economies.

DESCRIPTION OF THE RELATED ART

A search of the prior art located the following United States patents and publications which are believed to be representative of the present state of the prior art: U.S. Pat. No. 6,595,718, issued July 2003; U.S. Patent Publication No. US 2003/0053861 A1, published March 2003; U.S. Pat. No. 6,422,784 B1, issued July 2002; U.S. Patent Publication No. US 2001/0018006 A1, published August 2001; U.S. Pat. No. 5,269,630, issued December 1993; U.S. Pat. No. 4,591,466, issued May 1986; and U.S. Pat. No. 4,507,069, issued March 1985.

BRIEF SUMMARY OF THE INVENTION

Concrete surfaces have been used extensively for the past fifty years as an economically attractive alternative to other construction materials. The interstate highway system and many state highways feature concrete roadway surfaces. In California, for instance, there are over 10,000 miles of pre-cast concrete slab highways. Most major airport runways are concrete. The majority of California's concrete slab highways were constructed between 1950 and 1970, with an expected slab life of 20-25 years. Most of the concrete slab highways and many of the airport runways in the United States were built at least thirty years ago. All are in need of repair to one degree or another.

Due to unforeseen traffic volume, traffic weights beyond the surface design specifications, and age, these concrete surfaces are failing. Once failure occurs, replacement of the failed section of concrete surface is a necessary, time consuming, and costly process. Concrete surface replacement methods in the art use impact removal methods for the failed concrete surfaces. After the failed concrete surface is removed, quick setting concrete or pre-cast concrete slab installation is used in the art.

Present impact removal methods, such as use of jack-hammers or jack-hammers attached to front-end arms of Bob-cat type equipment, often have significant negative impact on the roadbed base compaction, leaving the replacement section inadequately supported.

On-site, poured concrete replacement methods in the art require lengthy downtime of the highway system. This general quick fix of pouring the concrete directly on site requires specialized concrete formulations. They also take one to two days to completely cure before traffic can resume over the repaired section. Fast setting concrete formulations present added transportation and application costs and are expensive in themselves. They are unpredictable and sensitive to slight climactic variations. Occasionally delays such as traffic congestion cause the concrete to set up in the cement mixing truck in transit.

Placing pre-cast slabs into the spaces created by removing the failed concrete sections decreases roadway downtime, lowers repair costs, and provides longer replacement slab life over on-site poured concrete methods and systems. However, using methods and apparatus in the art, pre-cast slabs present transportation, handling, and placement costs and related problems. These pre-cast slabs, once in the hole created by removal of the failed concrete, are raised or "jacked up" by injection of a fluid binder material through holes drilled through the slab and/or from the slab perimeter to form a monolithic bulbous load supporting member to support the slab to match the planar surface of the surrounding, adjacent slabs. The "jacked-up" injection methods in the art begin injecting fluid binding material such as grout or foam under one end of the replacement slab and continuing the injection down and back on the slab length until the slab top surface is visually aligned with surrounding concrete surfaces. These methods are both time consuming and lack precision. Tolerance clearance around replacement slabs are approximately one inch plus or minus, while the void under the slab can be a little as one-quarter inch. Since slab surfaces range from 150-200 square feet, these clearance and void dimensions are, relatively, quite small. Vertical sag of approximately 2.5 percent in the center of the replacement slab could put the replacement slab in direct contact with the supporting roadbed. The contact results in an uneven distribution of load spreading grout and a corresponding high potential for early for early replacement slab failure. Accordingly, even grout distribution between the roadbed and the replacement slab requires no replacement slab sag.

The grout or foam interface between the slab and roadbed needs to be applied as evenly as possible to create a uniformly distributed and uniformly dense grout interface to support the pre-cast replacement slabs evenly on the underlying road base. Voids or less dense areas of grout or foam under the replacement slabs could cause them to fail under the sudden weight loads of vehicular traffic traveling over the replacement slabs. The quick on/off force of traffic at speeds above 50 miles per hour acts as a giant jack hammer exerting forces of up to 18,000 pounds per axle, repeatedly pounding the slab. This repeated pounding leads to slab demise and negatively impacts the direction of cars traveling on the road surface.

It is, therefore, an object of the present invention to repair concrete surfaces without impacting the supporting sub-surface base.

It is another object of the present invention to mechanically guide the replacement concrete slab precisely into proper position in the concrete surface space to be filled including, but not limited to, surrounding unaffected concrete surfaces and relative to the underlying supporting roadbed.

It is yet another object of the present invention to decrease the time required to replace failed concrete surfaces over the art.

It is still yet another object of the present invention to decrease the costs associated with replacing failed concrete surfaces over the art.

A further object of the present invention is to simplify replacement of failed concrete surfaces and to do so more safely.

Yet another object of the present invention is to minimize the disruption of regular traffic flow attendant to replacement of failed concrete surfaces.

Other features, advantages, and objects of the present invention will become apparent with reference to the following description and accompanying drawings.

DETAILED DESCRIPTION OF THE INVENTION

Figure 1:
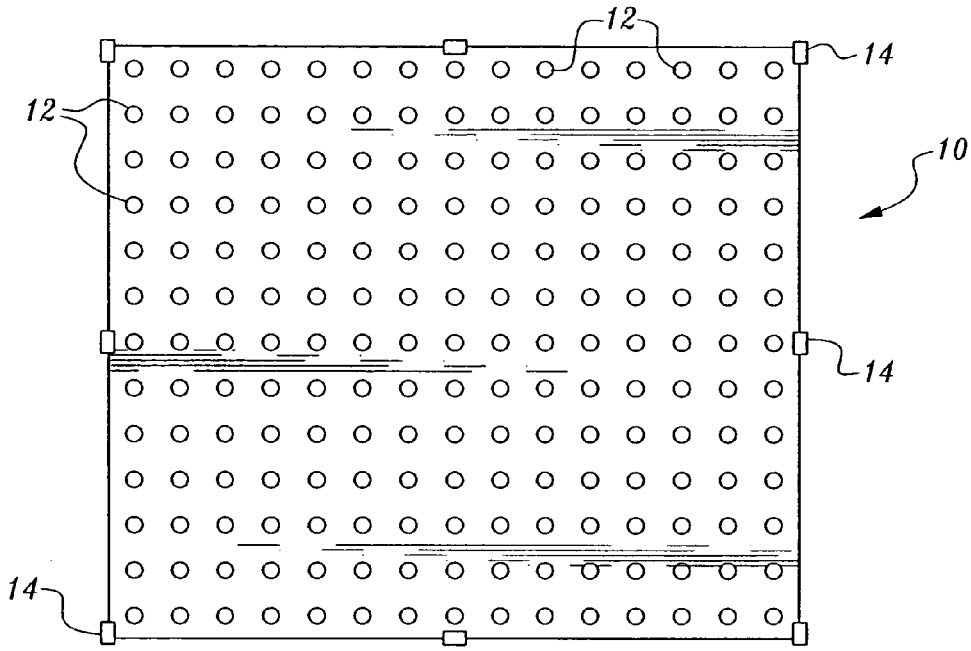
FIG. 1 is a top view of a broken concrete slab removal plate of the present invention.

The apparatus and system of a preferred mode of the present invention removes broken concrete surface slabs in four lifts or less. As shown in FIG. 1, an embodiment of the present invention uses a rectangular broken concrete slab removal plate 10 approximately 7 feet by 8 feet, or slightly larger than a quarter section of highway slab. The removal plate 10 can be various sizes or geometries, even as large as an entire highway slab. The removal plate 10 is made of solid material comprising a substantially uniform thickness, plate edge boundaries, a planar plate top surface and a planar plate bottom surface. The rectangular removal plate 10 of the 7 feet by 8 feet dimension of this embodiment is a block of material, such as metal, high strength poly-carbon, or the like, thick and strong enough to support weights of approximately 5 tons for removal of quarter-cut concrete slabs.

The removal plate 10 further comprises a plurality of small diameter openings or holes 12 drilled through the plate 10 wherein each hole diameter defines a centerline perpendicular to the plate planar top and bottom surfaces, and crane pick points 14 at the removal plate 10 edge boundaries, or at the four corners of the removal plate 10, and/or at mid-points on each of the removal plate's 10 four sides. An embodiment of the invention provides as many holes as solid surface depth, yielding a 1:1 ratio of holes to solid removal plate 10 metal material. Interior pick points 14 could be added depending on the particular circumstances and geometry of the slab removal. The larger sized plate 10, also can be used once affixed to a replacement slab to align the replacement slab to planar surrounding slabs and to suspend the replacement slab creating smaller interface voids between the replacement slab bottom surface and existing supporting roadbed by having the length of the plate 10 overlap onto each of the planar slabs surrounding the replacement slab. Alignment of the replacement slab in the traffic flow direction, which generally is along the longitudinal axis of the replacement slab, is most critical.

Figure 2:
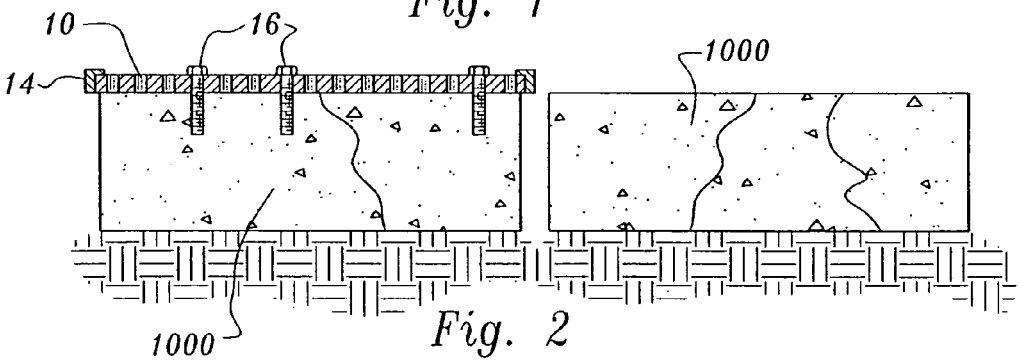
FIG. 2 is a sectional side view of a broken concrete slab removal plate of the present invention attached to a broken concrete highway slab as depicted in FIG. 3.
Figure 3:
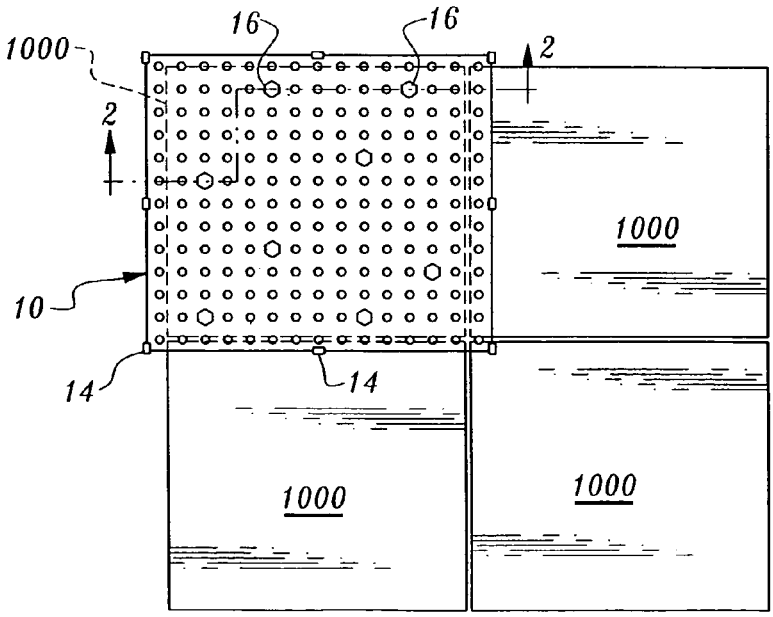
FIG. 3 is a top view of a broken concrete slab removal plate of the present invention attached to a quarter section of a broken concrete highway slab cut into quarter sections approximately 6 feet in width by 7½ feet in length.

As depicted in FIGS. 2 and 3, the plate 10 is securable to the broken concrete highway slab 1000 planar top surface by anchors 16 bolted through the one or more of the plurality of small diameter openings or holes 12 drilled through the plate 10 and into the slab 1000. FIG. 3 shows a typical removal plate 10 arrangement of the present invention attached to an approximately squarish shaped, cut quarter broken concrete highway slab segment 1000. The irregularity of sizes created by concrete failure indicated along crack-line faults normally makes it difficult to secure the odd shapes for broken slab removal. Contact over the entire broken slab surface with an appropriate number of approximately evenly distributed anchors resolves this engineering dilemma. Snugging the broken pieces to the plate prevents torque twisting that easily could result in anchor rod failure. This feature of the present invention greatly improves the removal characteristics over adjustable frame type removal apparatus in the art. By virtue of the 100 percent surface contact, torque twisting is also eliminated for irregular slab segments not perfectly centered according to the center of mass of the slab segment. The continuous surface interface of the plate 10 bottom to slab 1000 top planar surface, combined with anchors 16 securing the same interface, prevents any lateral, twisting or moment force on the anchor points 16 as the slab 1000 is lifted. Adjustable frame inventions in the art require nearly perfect weight adjustment to the centroid to avoid these forces, a complex on-site engineering adjustment problem created by the irregular shapes of broken concrete. For most applications in this system a couple or several anchor points 16 secured into each broken slab 1000 segment through the plate holes 12 provides adequate anchor strength and slab support from the removal plate 10. These anchor points on broken irregular slab pieces need not be positioned with engineering calculations to account for a weight centroid, but rather are spread evenly by visual alignment across the irregular shape.

The removal plate 10 unifies and strengthens the cut section of broken slab 1000 into one piece allowing safe and quick removal of the damaged slab 1000. The broken pieces of the slab cannot move vertically or horizontally. They are secured to the removal plate 10 across the entire bottom removal plate 10 planar surface. The stability of the slab so attached minimizes the likelihood of anchor failure while the slab is being removed by allowing for shorter anchor bolts than those used for a frame type apparatus. There is little tensile strength in these lifting coil rods. The snug fit at multiple locations also prevents the twisting torque moments irregular shapes and weights might produce which would also likely cause anchor rods to fail.

Concrete highway slabs in the United States typically range from 8 inches to 12 inches in depth. These slab depths may vary widely in other countries depending on expected loads and the environment of the roadbed. The preferred method of the system of the present invention is to cut the broken concrete highway slab 1000 into quarter sections, FIG. 3, approximately 6 feet wide by 7½ feet long by 10 inches deep. Cut broken concrete slab sections of these dimensions are manageable, and fit easily and safely into removal transport vehicles using small lifting cranes. Failed concrete slabs can be cut using large, circular concrete saws in the art. Or cuts can be precisely and speedily performed using jig saws, laser saws, or water jet saws in the art. Use of these saws are combined with global positioning technology to input the precise cut location to a microprocessor database. This database includes, among other necessary data, the size and depth of cut, the size and depth of slab, and the precise location of the cut. The improved laser or water jet cutting means also eliminate short-comings the rotary concrete sawing methods in the art.

Rotary saws in the art are slow, operator sensitive, and prone to jamming and blade breakage. Slab cut measurements by rotary saws are by nature imprecise. A typical rotary saw cut is made three times with differing diameter saw blades ranging from small, about 16 inches, to large, about 36 inches. At the boundary edges of the broken slab to be removed, the rotary blade cuts into surrounding slabs as it reaches the perimeter bottom of the broken slab. This invasive cutting action weakens these unbroken slabs. Typical rotary blade costs are approximately $3,000.00 for large blades used to cut highway sized concrete slabs. Rotary saw blades wear fast, are expensive and prone to breakage, and are especially sensitive to operator skill. Thus, in keeping with the improved efficiency and safety of the system and apparatus of the present invention, improved slab cutting means are pursued.

Full sized highway concrete slabs are too wide for regular transport, and require a special sized vehicle with the appropriate "wide load" warning signs displaced on the front and rear of each such vehicle or pilot vehicles accompanying the oversized vehicle displaying similar road hazard warning signs. The slab cutting step of the present invention reduces handling weight of the slab removal and also reduces the size of the removed broken concrete slabs. The removed quarter section slabs can easily fit into the bed of standard sized dump trucks or other transport vehicles. There is no need for special sized flatbed trailers, nor extra pilot-vehicles to accompany such over-sized loads traveling down highways. The containment requirements presented in the art for over-hanging portions of whole broken slab extending two feet on each side of a flatbed removal transport are also eliminated by use of the slab cutting step of the present invention.

The plurality of holes 12 in the removal plate 10 of the present invention allow anchoring by expanding dead bolt, threaded receivers 16 to be easily adjusted into patterns which best adhere to and hold each of the irregular pieces of broken slab segments within the quarter section of the cut highway slab 1000 marked for removal and repair, FIG. 3, in one cohesive unit. The removal plate 10 of the present invention can accommodate a plurality of varying sized expanding dead bolts. For example, a standard ⅝ inch expanding dead bolt cannot be placed within one foot of the perimeter of a broken slab segment; however smaller expanding dead bolts, down to ¼ inch can be placed closer to the broken slab segment edge. The removal plate 10 of the present invention is flexible and secure enough to support all relevant sized holes drilled into the broken slab segment. This feature improves the slab removal apparatus or methods in the art, particularly adjustable frames, where slot channels must nearly touch anchor rod sides to prevent breakage of the rods due to torque forces and the long rod lengths. The present invention avoids this type of failure by having plate holes larger than the largest slab drilled hole, approximately ⅝ inch. Thick overlapping washer type pieces of metal or other suitable strong material with a circular insert lip fitting the plate hole are used with these oversized plate holes, centering the plate hole for the anchor rod selectively sized for use.

Crane lift requirements also are reduced by the present invention to approximately 5 tons. By placing the flat quarter sections of broken slab segments into a removal vehicle, and then walking onto the removal plate 10, unbolting the removal plate 10, and lifting the removal plate 10 by crane from the removed flat quarter section of broken slab segment 1000, the debris intensive methods of jack-hammered slab removal in the art are avoided. The removed flat quarter sections of broken slab segments readily are stacked one-upon-another, until the load limits of the respective removal vehicle are reached. Additionally, since jack hammering is not necessary for the system of the present invention, the underlying roadbed is not impacted by removal of the broken concrete slab.

Methods of slab replacement in the art throw replacement slabs onto the ground and then jack-up the replacement slab by injecting binder material through holes drilled through the replacement slab until the replacement slab matches its surrounding planar surfaces. This jockeying of slab requires several men and considerable time to properly complete the process. Even so, location of the replacement slab is only eye accurate or less, and there is no definitive way to insure that binder material is uniformly distributed to an adequate depth density and even consistency. Operational efficiency under these circumstances depends on an experienced crew using best efforts.

Figure 4:
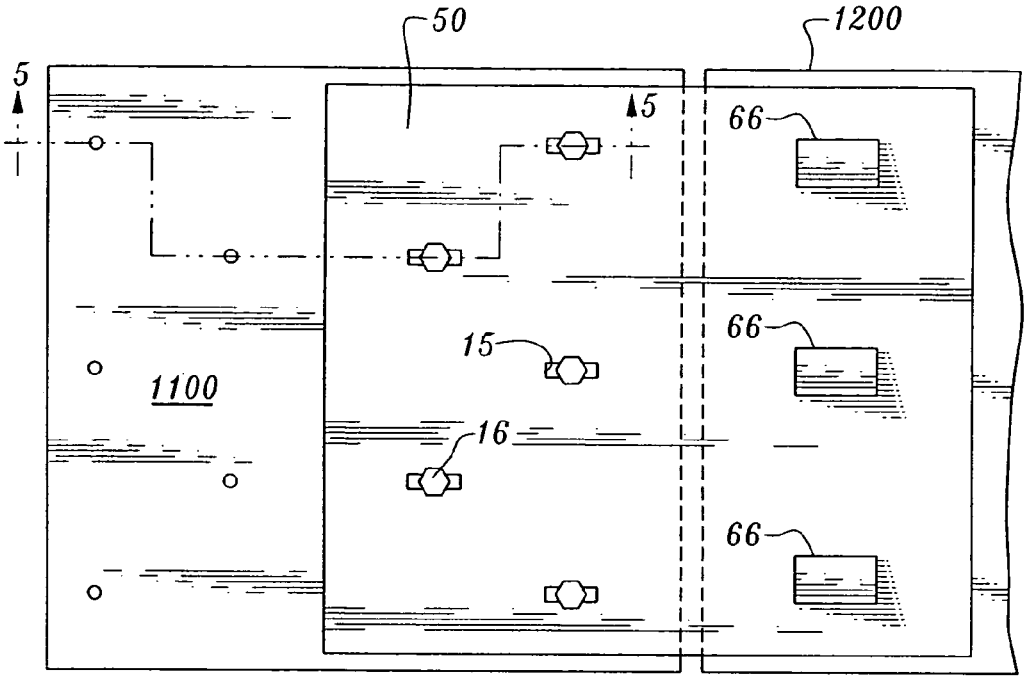
FIG. 4 is a top view of bridge slab replacement apparatus of the present invention which allows the replacement slab to be suspended over the placement hole creating a small ¼ inch to ½ inch void for the grout interface, and which allows the replacement slab to be aligned with surrounding planar surfaces of the highway.
Figure 5:
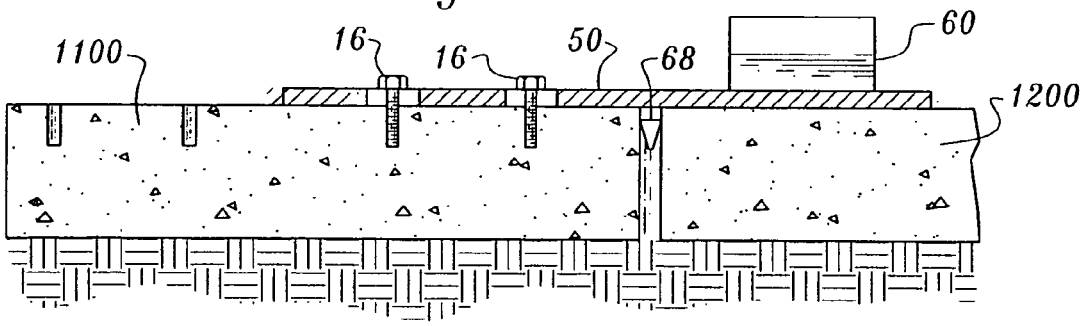
FIG. 5 is a side view of the bridge slab replacement apparatus of FIG. 4.
Figure 13:
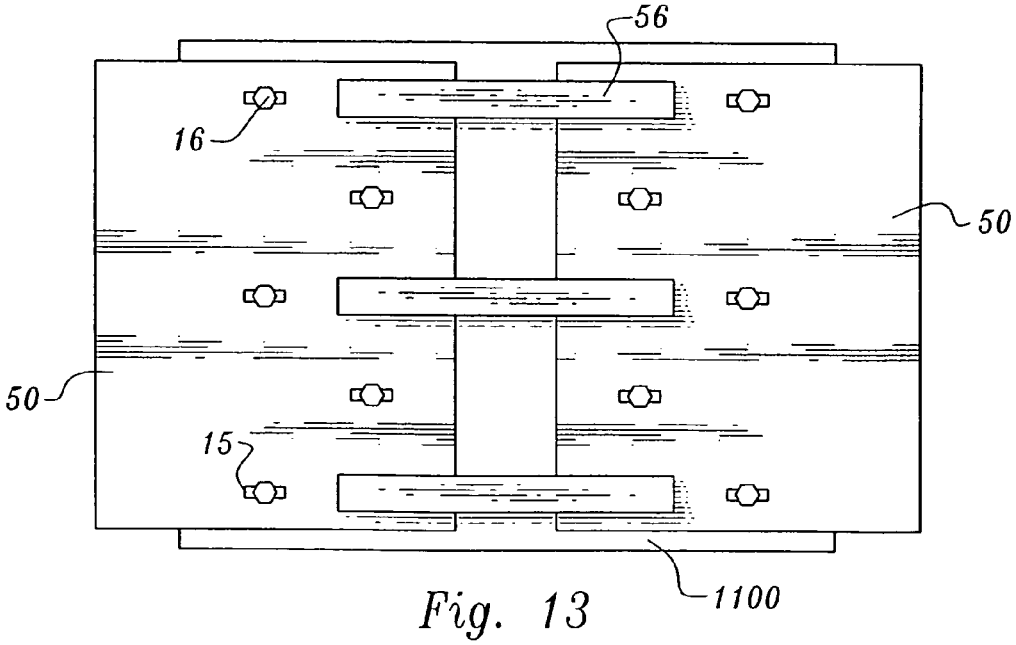
FIG. 13 is a top view of an embodiment of bridge weight plates of the present invention affixed to a replacement slab in transport mode.
Figure 14:
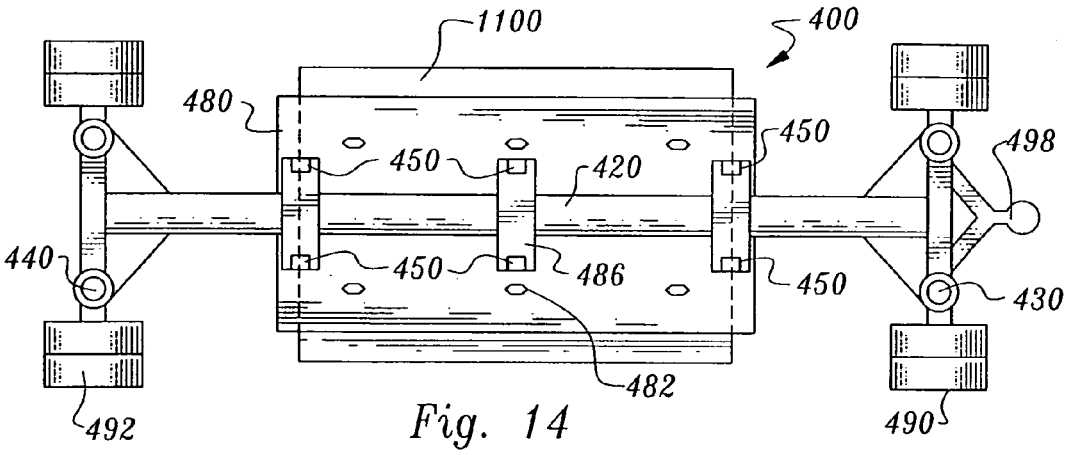
FIG. 14 is a top view of an embodiment of replacement slab carrier transport trailer of the present invention in travel mode.
Figure 15:
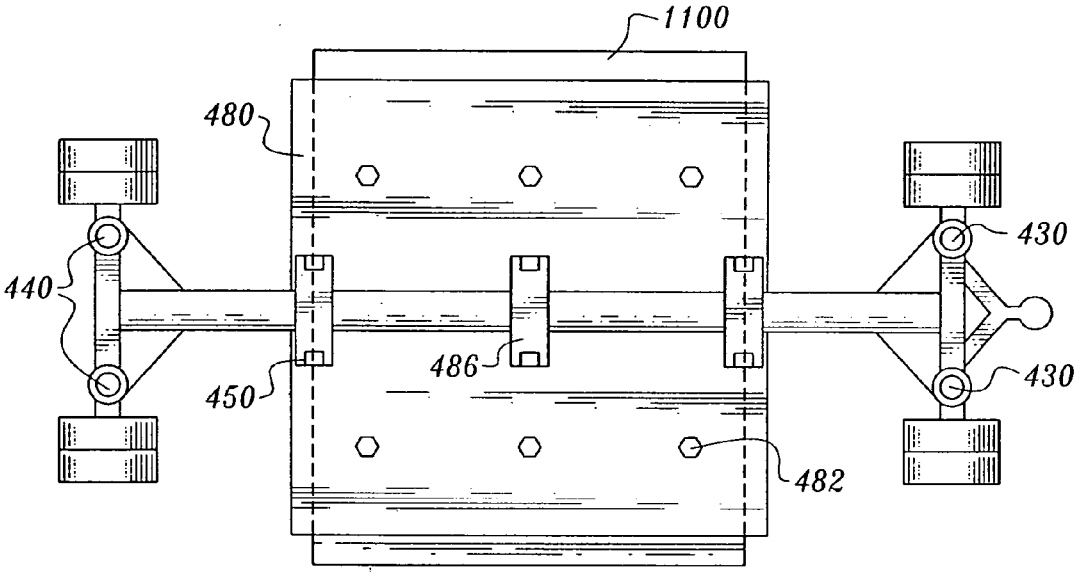
FIG. 15 is a top view of an embodiment of replacement slab carrier transport trailer depicted in FIG. 14 in slab replacement mode.
Figure 31:
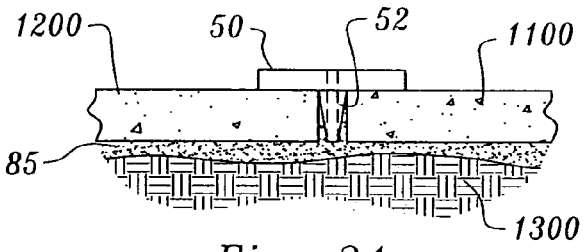
FIG. 31 is a side view of a preferred embodiment of bridge slab replacement apparatus of the present invention showing a bridge plate with weight/anchoring device and grout injector collar.
Figure 32:
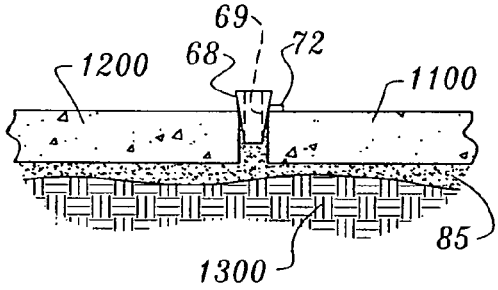
FIG. 32 is a side view of an embodiment of bridge slab replacement apparatus of the present invention showing a grout injection and guide collar with grout slot and attachment lip.

An alternate carrier or bridge plate 50 embodiment of the apparatus of the present invention is presented in FIG. 4 for positioning and installation of the replacement concrete slab 1100. The carrier or bridge plate 50 is made from solid material comprising a predetermined geometry that is longer than the replacement slab to which the plate is joined, substantially uniform thickness, plate edge boundaries, a planar plate top surface, a planar plate bottom surface, and a longitudinal plate axis. Plate width can also be larger than the attached replacement slab; however, the critical dimension is plate length since the preferred planar alignment of the replacement slab is dictated by the flow of traffic. Plate thickness is determined by the strength needed to avoid deflection of the plate ends and downward flex due to weight in the center of the plate/slab unit. This feature of the present invention is a critical improvement over the art, namely adjustable frames which comprise beams light enough for manual adjustment but not strong enough to prevent end deflection or mid-slab sagging within the interface void between the slab bottom side and the underlying roadbed substrate. Depending on the slab surface geometry, carrier or bridge plates 50 planar bottom surfaces are affixed to the planar top surface of the replacement slab 1100 by anchors. Accordingly, the replacement slab 1100 is suspended over the roadbed. Weight can be added to the replacement slab, or as part of a bridge from the carrier or bridge plate 50 top planar surface to the substantially planar top surfaces of adjacent existing slabs 1200, as counter balance to the uplift force of high strength grout or polymeric foam pressure injected under the replacement slab 1100. In this manner, consistent and uniform density of the high strength grout or polymeric foam so injected in ensured. Again, depending on the surface and roadbed conditions, these carrier or bridge plate 50 sizes and geometries can be varied to fit the intended purpose of keeping the replacement slab 1100 suspended above the roadbed surface, as shown in FIGS. 4, 5, 27-30. The space between the replacement slab 1100 bottom and the roadbed can be exploited to pressure inject fluid binding materials such as high strength grout or polymer, or expanding foam more uniformly and consistently than "jacking" methods in the art. And the process of the present invention is faster than the "jacking" methods as there are no barriers or blockages met and no slab lifting to slow it down. In one embodiment, the carrier or bridge plate 50 width is nearly the width of the replacement slab 1100, FIG. 15. In the embodiment of FIGS. 4, 13 and 15, anchor points 16 are positioned through slots 15 in the carrier or bridge plate 50 so the high strength grout or polymeric foam injection collar 68 can be positioned adjustably to guide and snugly fit the up to the end of the replacement slab 1100. This embodiment is useful for any of the varying lengths of concrete slabs used to prevent harmonic vibration caused by interaction of slab spacing and traversing vehicular traffic. There could also be slot 15 above the collar matching holes in the collar 68 for high strength grout or polymeric foam injection. The collar 68 comprises either a "V" cross-section with a top width greater than a base width, e.g. FIG. 5, 31, or 32, or a right angle triangle geometry, with the base of the triangle flush against the replacement slab side and the hypotenuse serving as a guide element, FIG. 23A. The collar 68 could be entirely separate from the carrier or bridge plate 50, thus necessitating holes in the carrier or bridge plate 50 through which high strength grout or polymeric foam is injected. In the separate collar embodiment, slots for the carrier or bridge plate 50 anchor adjustment are provided.

Ramps are used to locate the replacement slab as close as possible over the space vacated by the removed broken slab. Embodiments of the injection guide collar comprising either the "V" cross-section or right triangle cross-section precisely locate the last inch of tolerance. To get the replacement slab from the location provided by the ramps to be in position to fit into the space vacated by the removed slab often may require an adjustment mechanism to controllably wobble the replacement slab into position.

Once the replacement slab is rotated such that its planar top surface is aligned with a horizontal plain nearly over the space vacated by the removed slab, the hydraulic arms join the plate to the carrier spine by a heim joint connection at each end of the hydraulic arms. By slight adjustment the slab is wobbled within the horizontal plane without compromising vertical load, strength, and length until proper planar surface alignment is achieved and verified by global satellite positioning, survey, or other means known in the art.

Figure 29:
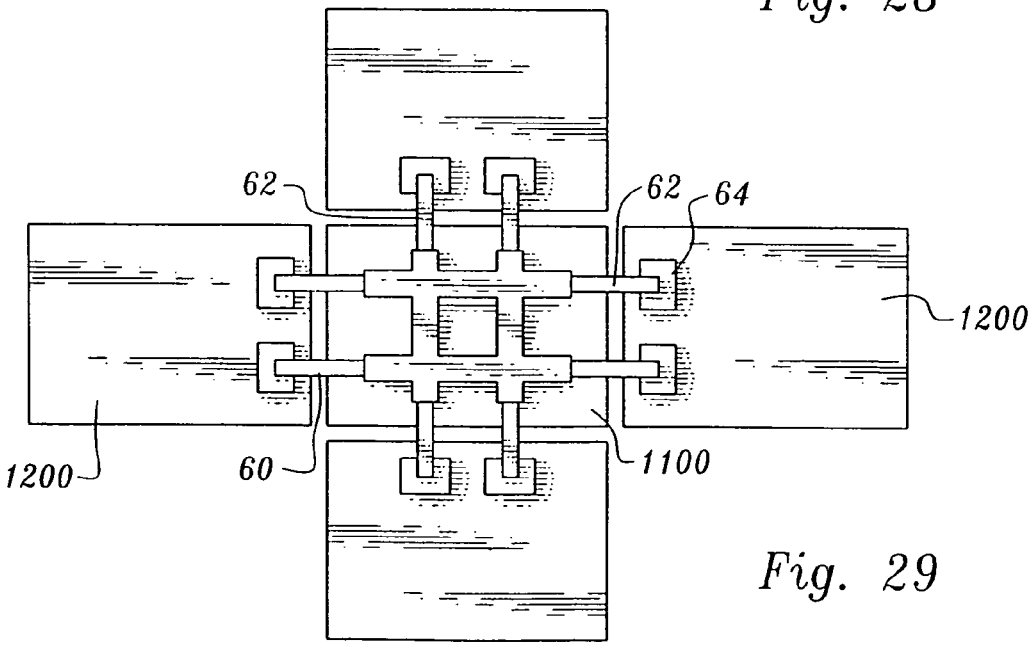
FIG. 29 is a top view of a preferred embodiment of bridge slab replacement apparatus of the present invention showing a bridge plate with weights/anchoring devices.
Figure 30:
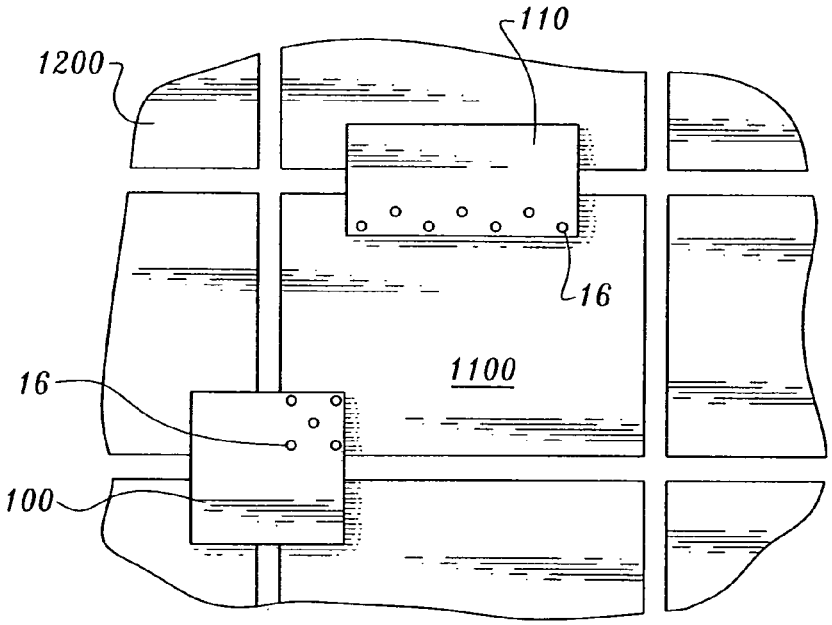
FIG. 30 is a top view of an embodiment of bridge plate assemblies showing alternative sizing and anchoring points for alternative bridge plates.

Another embodiment of the carrier or bridge plate 50 assembly of the present invention for positioning and installing the replacement slab 1100 is presented by FIG. 29. A central cross assembly 60 is anchored to crane pick points near the replacement slab's 1100 center. This cross assembly 60 has a plurality of separately adjustable arms 62 extending outward, and each such arm 62 has at its outward bridge end a plate 64 to rest on the adjacent existing concrete slabs 1200. These plates 64 can be further weighted to counter balance any uplift phenomena during high strength grout or polymeric foam application, if necessary, as further shown in FIGS. 4, 5, 27-29. The counterbalancing weights can be applied anywhere on the replacement slab 1100 as well as on the bridge end plate on an adjacent slab 64, FIG. 29, or 66, FIGS. 4 and 5. Often, the weight of the replacement slab 1100 will be sufficient counterbalance to assure that the high strength grout or polymeric foam distribution is consistent and uniform beneath the replacement slab 1100 without the need for weight on the bridge end of an adjacent slab. Thus, an even concrete highway transit surface from slab to slab is more possible. This system also minimizes any disruption to the roadbed support surface under the replacement concrete slab by suspending the replacement slab 1100 above the non-impacted roadbed.

As shown below, the proprietary, specially designed replacement slab carrier assembly system serves both as transport and lifting/positioning apparatus. These embodiments for slab replacement eliminate the need for wide load warning requirements. Similarly, flatbed trucks to transport the replacement slab and larger lifting cranes, 15 tons or more, to position or lower the slab are not necessary using this embodiment of the present invention.

The high strength grout or polymeric foam injection collar 68, as more specifically detailed in FIGS. 5, 23, 31-33, serves to place the replacement slab 1100 precisely equidistant from all the surrounding existing slabs 1200. This equidistant positioning is critical to create a uniform consistent vertical interface between adjacent existing slabs 1200. These equidistant spaces serve as expansion joints between slabs allowing for expansion and contraction between slabs due to climactic circumstances, traffic pressure or forces, and roadbed foundation dynamics. In the art, poured-on-site replacement concrete displace these expansion/contraction joints to a new perimeter surrounding five slabs instead of one. The poured-on-site approach invites early slab failure since the potential for crack stress failure increases exponentially with size. The injection guide collar of the present invention insures uniformly even expansion/contraction joints on all sides of a single replacement slab.

The collars 68 also serve to provide service inlets for high strength grout or polymeric foam injection slots while sealing the joints. This critical feature forces high strength grout or polymeric foam to flow under the slab, between the suspended slab bottom surface and the top of the roadbed and against the solid interface area of adjacent existing slabs, and prevents flow out of the joint. These same inlets can function as outlets, permitting measurement of the arrival of grout at the perimeter point. In this fashion, when the pressurized grout is applied internally through the slab, FIGS. 6 and 7, the grout application is uniformly dense because it is injected under static pressure across the entire void between the replacement slab bottom and the roadbed.

Figure 23A:
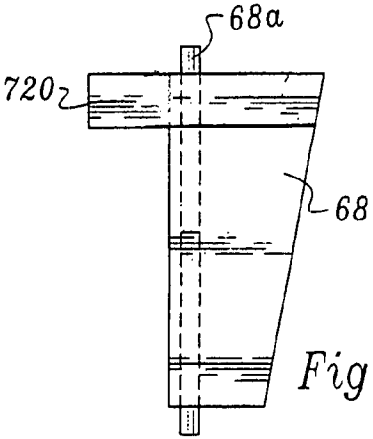
FIG. 23A is a sectional view of the grout injection and guide collar and extensions of FIG. 23.
Figure 23:
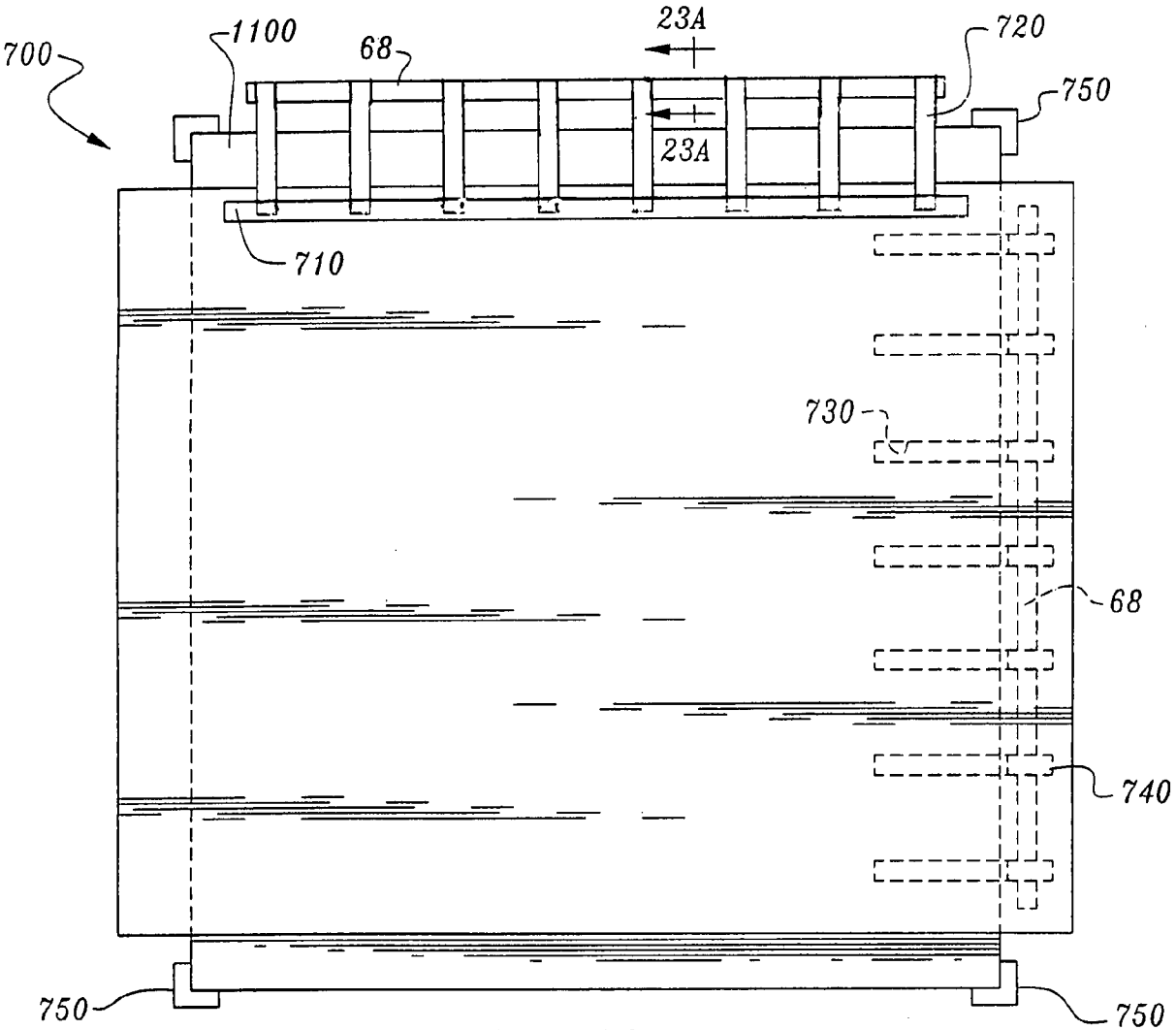
FIG. 23 is a top view of an embodiment of an adjustable slab replacement plate of the present invention depicting grout injection and guide collar and extensions, wherein the collar is shorter than the replacement slab to accommodate differing sizes of replacement slabs.
Figure 33:
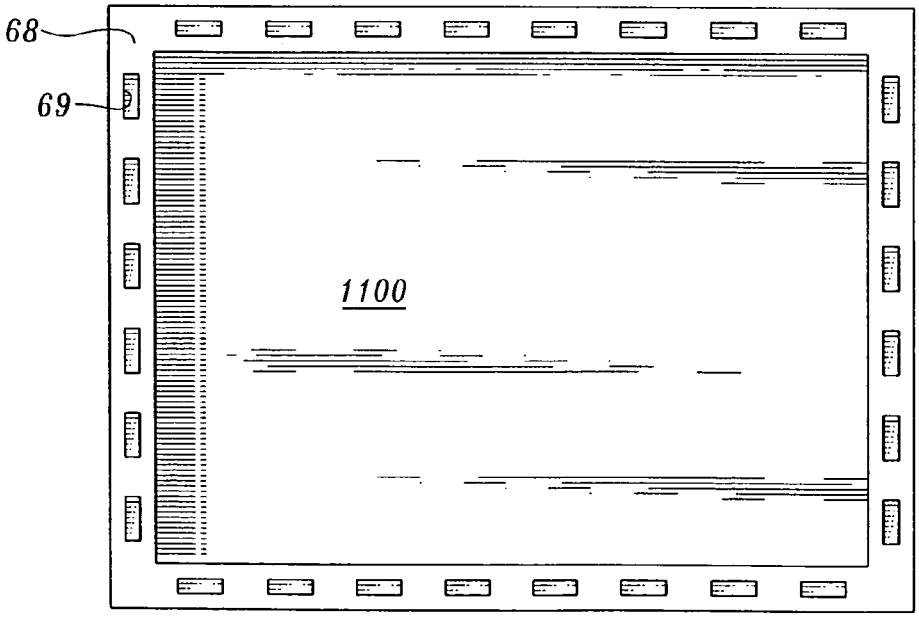
FIG. 33 is a top view of an embodiment of bridge slab replacement apparatus of the present invention showing a perimeter collar with holes or slots for grout injection.

FIGS. 23 and 33 show embodiments of the collar's 68 equidistant placement surrounding a replacement slab 1100. This feature is critical to ensure a precisely uniform joint between the replacement slab and the adjoining existing slabs. As shown, part of the collar 68 can be under the carrier or bridge plate 50, FIGS. 5 and 31, or the collar 68 may be a separate guide/group input wedge element unto itself, FIGS. 23, 32, and 33. Once the high strength grout or polymeric foam has been allowed to set for a short period, the bridge plate(s) 50 and collar(s) 68 are removed from the replacement slab 1100. The remaining open vertical space could be filled with a different, more elastic grout or any appropriate grout or binder material for expansion and contraction phenomena between the replacement slab and the adjacent slab surface edges.

Figure 6:
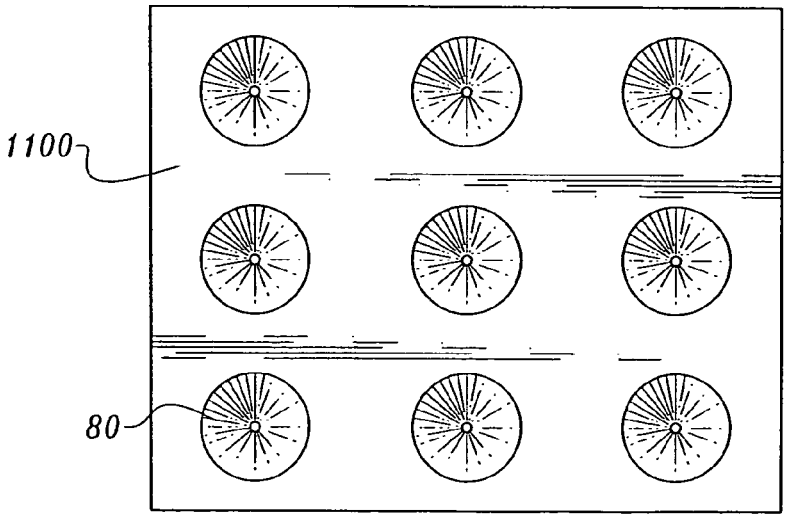
FIG. 6 is a bottom view of an embodiment of precast concrete replacement slab of the present invention showing channels to facilitate even and uniform grout input across the entire slab bottom without holes or air pockets.
Figure 7:
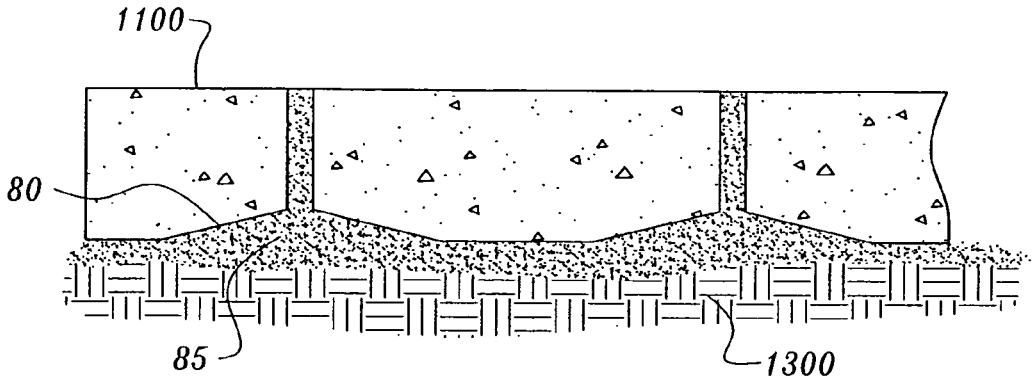
FIG. 7 is a side view of the channels of the precast concrete replacement slab of FIG. 6.

Replacement slabs 1100 can be pre-cast with reverse form patterns, such as channels, or the like, 80 to facilitate the flow of high strength grout or polymeric foam uniformly across the underside of the suspended replacement slab 1100 as shown in FIG. 6. The replacement slab channels 80 promote the high strength grout or polymeric foam to create a uniformly consistent interface layer 85 between the replacement slab 1100 and the underlying road base support surface or subgrade 1300, FIG. 7. The interface layer 85 is critical to the life of the slab since the applied high strength grout or polymeric foam resolves irregularities on both the roadbed and replacement slab bottom to create a uniform load transmission caused by vehicular traffic pounding forces on the slab and on to the solid bedrock of roadbed surface below the slab. Thus, the uniformity of fluid binding material distribution and density is critical to replacement slab life. Any irregularities in high strength grout or polymeric foam distribution or density leads to weak points, harmonic vibrations, or other irregular pressures that could result in untimely failure of the replacement slab.

While this reverse form pattern feature may not be needed in all applications, patterning the suspended replacement slab bottom enhances fluid binding material interface between the slab bottom and the roadbed. In some instances, replacement slab 1100 thickness may be reduced ⅛ inch to ¼ inch using the patterned replacement slab bottom technique of the present invention. These slightly thinner replacement slabs 1100 allow high strength grout or polymeric foam to cover high spots on the roadbed that the high strength grout or polymeric foam would otherwise flow around. This minimal reduction in thickness does not effect the replacement slab 1100 strength; however, the improved fluid binding material interface increases the replacement slab life in the highway surface. The reverse foam pattern on the replacement slab bottom side, FIG. 6, also decreases time needed to push the thick, viscous binder material by providing a less restrictive environment for movement of the same between the subgrade roadbed and the slab bottom surface.

From the data provided from the laser or water jet saw cuts, each replacement slab can be precisely configured and prefabricated for the space in the repaired surface to which it will be suspended. Use of bar coding and global positioning technology in the system of the present invention ensures proper replacement slab placement.

Figure 8:
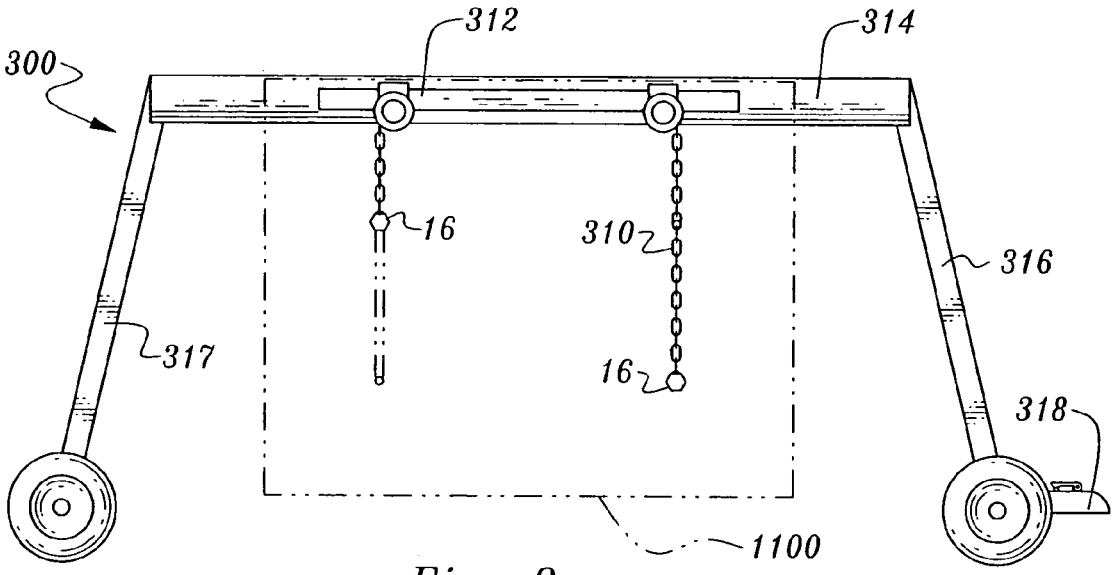
FIG. 8 is a side view of an embodiment of replacement slab carrier transport trailer of the present invention in travel mode using a chain hoist and rotational roller mechanism to rotate, raise, and lower a replacement slab.
Figure 9:
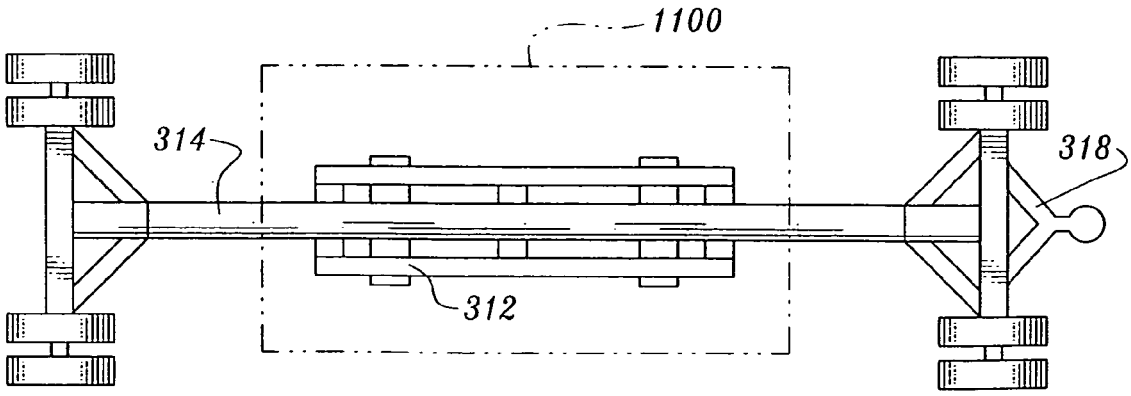
FIG. 9 is a top view of the embodiment of replacement slab carrier transport trailer of the present invention depicted in FIG. 8.
Figure 10:
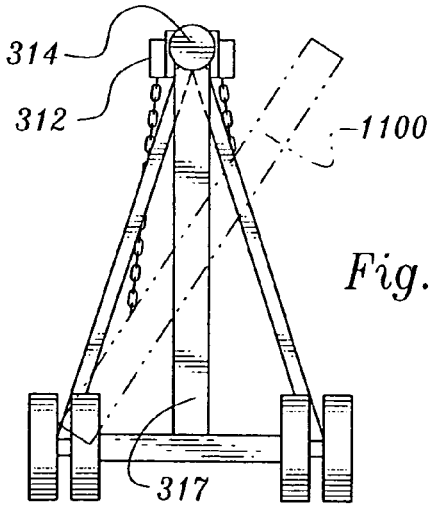
FIG. 10 is an end view of the embodiment of replacement slab carrier transport trailer of the present invention depicted in FIG. 8.
Figure 11:
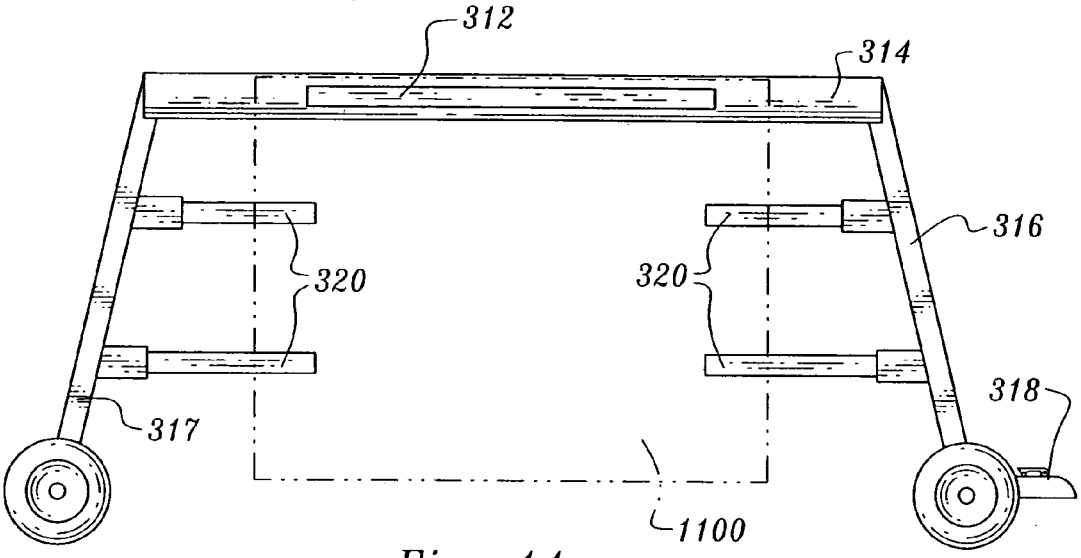
FIG. 11 is a side view of an embodiment of replacement slab carrier transport trailer of the present invention in travel mode showing stabilizing bars employed.

FIGS. 8-11 show an embodiment and related elements of the replacement slab transport trailer system of the present invention which facilitates installation in several ways: a) the trailer apparatus 300 can be hooked to any appropriate tractor or truck to transport the replacement slab to the designated position on a highway or concrete surface; b) 12 foot wide slabs can be rotated and transported so that the combined slab and trailer is less than the maximum 8 foot normal highway vehicle width, FIGS. 8, 10, and 11; c) the apparatus can be returned to the horizontal position and then the attached plate/slab unit lowered into place, suspended above the roadbed by the plate system, in the concrete surface being repaired, FIG. 9; and d) the carrier system can be linked to global positioning technology and/or bar code identification technology to ensure each replacement slab is suspended at the accurate location in the repaired concrete highway surface.

The embodiment of transport trailer system of the present invention depicted in FIGS. 8-11 comprises in combination a frame capable of supporting and transporting replacement concrete slabs weighing approximately 25,000 pounds. The trailer has a longitudinal frame axis, a front frame member 316 having a top portion and bottom portion, a rear frame member 317 having a top portion and a bottom portion, and a main support beam member 314 connecting the front frame member and rear frame member by attachment to the top frame member portions. The connecting support beam provides a top surface, a bottom surface, and two side surfaces. Wheel mounting members are pivotally joined to the front frame member bottom portion and wheel mounting members are fixedly joined to the rear frame member bottom portion. A hitching tongue 318 projects forward from and is joined to the wheel mounting members connected to the front frame member bottom portion. Wheels are rotatably disposed on the wheel mounting members.

Chain, cable, or the like, 310 serve to attach the replacement slab 1100 to the roller mechanism 312 on the main horizontal support beam 314 of the carrier transport trailer 300. The other end of the chain, cable, or the like 310, is attached to pick points 16 pre-placed in the pre-cast replacement slab 1100, FIG. 8. Each carrier transport trailer 300 is less than approximately 8 feet wide and 26 feet long, without hitching tongue 318, FIGS. 8, 9, and 11. The rotation means allows transport of a full sized highway slab on highways without the necessity of specialized vehicles, "wide load" warning signs, and related precautions. By using global positioning technology and/or bar coding identification, or similar means, for locating replacement slabs within carriers, several carriers could be linked in the particular specific order of slab replacement required for a length of damaged surface, and slab suspension at the precise location for each replacement slab can be readily achieved.

Figure 20:
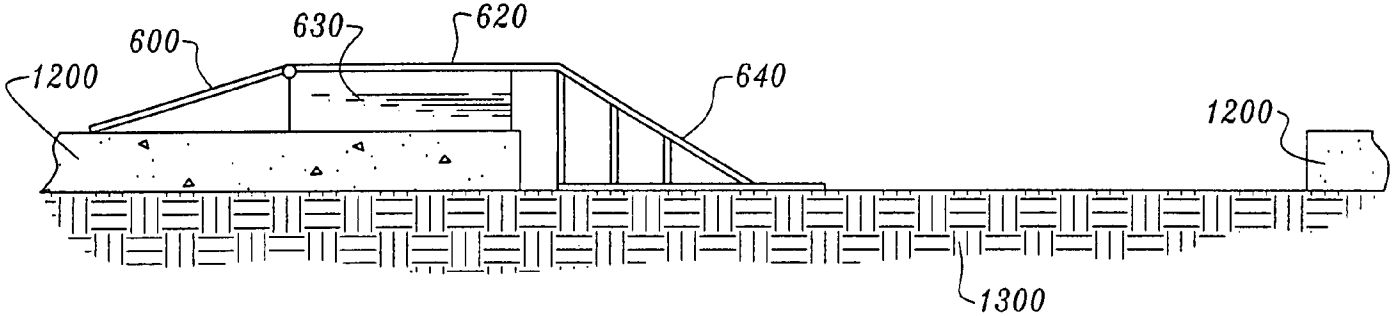
FIG. 20 is a side view of guide ramp assembly to position a replacement slab carrier transport trailer for slab placement.
Figure 21:
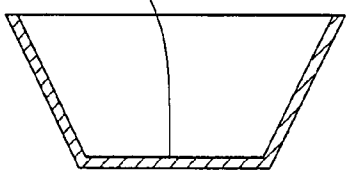
FIG. 21 is a sectional view of the wheel channel ramp of the guide ramp of FIG. 22.

Using removable guide ramp assemblies, FIGS. 20-21, the tractor or truck and the carrier transport trailer 300 drive into the hole to be repaired by the replacement slab. The ramp assembly, FIG. 20, provides an approach lip 600 with a beveled end and a hinged end wherein the angle of the ramp relative to surrounding concrete surfaces 1200 is adjustable. A pair of ramps 640 are so assembled, each having a channel 650, an outside edge, and inside edge, a ramp top, and a ramp bottom defining a predetermined uniform angle of declination from surrounding concrete surfaces, wherein the ramps are fixedly attached at a predetermined distance by at least two uniform cross members 670 affixed to the ramp inside edges. The ramp pairs are aligned within the space bounded by unaffected surrounding concrete surfaces by manual adjustment to guide mechanisms 660 affixed to the ramp outside edges. The ramp channels and cross members are sized to receive the replacement slab transporting carriers' wheel dimensions. Steel pads 630 provide height adjustment, if necessary, to an approach support member 620 having a first hinged end attached to the approach lip 600 hinged end and a second hinged end attached to the ramp tops, a top side, and a bottom side. Support member 620 height is adjusted by placing the required number of steel pads 630 between the support member 620 bottom side and unaffected concrete top planar surface 1200.

The truck and front trailer wheels drive down the ramps into the space and back up opposite side ramps positioning the slab accurately for any slight further adjustment and for lowering into the space vacated by the removed damaged slab. Alternatively, the carrier transport trailer 300 may employ a "lazy susan" type of connection to its axles so that the trailer can be precisely maneuvered sideway for exact placement of the replacement slab. This apparatus can be used at all the stages of the concrete slab replacement process-from pick up to delivery and installation.

Figure 12:
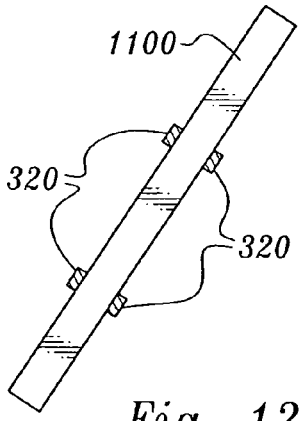
FIG. 12 is an end view of rotated slab showing stabilizing bars positioned and employed thereon.

As shown in FIGS. 11 and 12, the carrier transport trailer 300 comprises a plurality of stabilizer bars 320 which are put into place into the frame members after the replacement slab 1100 is raised and rotated within the carrier transport trailer 300 frame. The inserted stabilizer bars project rearwards perpendicularly from the front frame member 316 and project forward perpendicularly from the rear frame member 317, whereby the rotated replacement slab fits between corresponding inserted stabilizer bar pairs during transport of the replacement slab. Other mechanisms attached to the carrier transport trailer 300 frame also could be used to further stabilize the suspended replacement slab 1100. Because the replacement slab 1100 is suspended within the carrier by chain, cable, or the like, 310 side to side swinging potential is presented during movement of the carrier transport trailer 300. The stabilizer bars 320 or other means attached to the carrier transport trailer 300 frame prevent the replacement slab 1100 from swinging side to side during transport. The stabilizer bars 320 do not support any weight of the replacement slab 1100, and are quickly positioned within or removed from the carrier transport trailer 300 via sockets or the like positioned on and attached to the carrier transport trailer 300. Likewise, methods for locking the slabs to the carrier for safety could be added separate from stabilizer bars, or the stabilizer bars could be enhanced to provide any necessary strength for locking the slab to the carrier.

During transport, replacement slab carrier or bridge plates 50 can be anchored in place to the replacement slab 1100, as shown by the embodiment depicted in FIG. 13. Anchoring takes place before the replacement slab 1100 is lifted into the carrier transport trailer 300 for transport. Additional stiffeners, or transport cross links 56 can be attached to the two carrier or bridge plates 50 as may be necessary to support the replacement slab from center sag or flex. Concrete highway slabs have enormous compression strength but limited tensile strength. Concrete slabs transported over bumpy roads without adequate back support or truck-bed support could vibrate and/or flex under their own weight and crack or break before they reach the replacement site, requiring cross-hatched rebar or the like to be placed within replacement slabs in the art. The carrier or bridge plate 50 anchoring apparatus of the present invention supports the relatively weak tensile strength of the replacement slabs 1100, providing immense external support far exceeding internal rebar. The carrier or bridge plates 50 and stiffeners 56 add spine to the replacement slab 1100, and prevent cracks due to flexing caused by transport pressures and handling movement. The replacement slabs 1100 are strong when flat on the road-bed surface. The transport cross links 56 function like the aforementioned stabilizer bars to prevent the replacement slab 1100 from cracking under its own weight, nearly 25,000 pounds, during transport. Since the cross links 56 are not attached to the replacement slab 1100, they are quickly and easily removed from the carrier or bridge plates 50. The plate depicted in FIG. 13 could also be used for replacement slab placement within the apparatus depicted in FIGS. 14-19, 25, and 26. This embodiment of the carrier or bridge plate could effectively eliminate the need for internal rebar in replacement slabs to the extent that such materials are necessary to offset transport and placement stresses.

Other embodiments of carrier transport trailer 400, FIGS. 14-19, and 500, FIGS. 25, and 26, use the weight of the trailer to counter balance the uplift force of high strength grout or polymeric foam pressure injected under the replacement slab 1100. The carrier transport trailer 400, FIGS. 14-19 comprises mechanism means 450 to raise and lower and rotate the replacement slab 1100.

Figure 24:
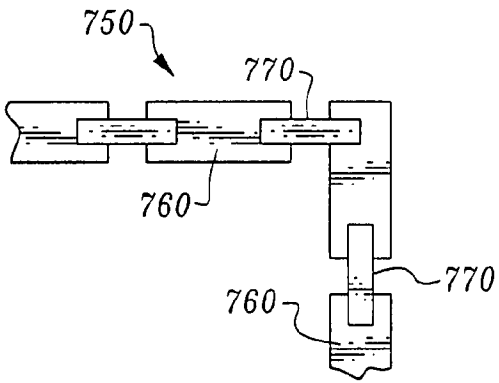
FIG. 24 is a top view of insert corners for the embodiment of grout injection and guide collar and extensions depicted in FIG. 23, whereby removable insert pieces are bridged one-to-another and onto the main injection collar.

In the transport mode, the carrier transport trailer 400, FIGS. 14, 17, 17A, and 19, supports the replacement slab 1100 in a position rotated to a width of approximately 8 feet and a height less than 11 feet, FIG. 24, by a central support spine 420. The central support spine 420 comprises one mechanism means for lowering/lifting and another for rotating 450 the replacement slab 1100 which is anchored to a support plate 480 by a plurality of anchors 482. The support plate 480 is supported by swivel anchors 484 each of which are connected to its separate, corresponding mechanism means for rotating 450 the replacement slab 1100. One embodiment of the present invention provides hydraulic ram arms as means for rotating 450 the replacement slab 1100. These hydraulic ram arms 450 are paired in the sets evenly spaced along the sides of the carrier central spine 420, FIGS. 14-15. The end pairs of hydraulic ram arms 450 carry the weight of the plate/slab mass in lowering the plate/slab mass. The center hydraulic rams serve as anti-flex members to maintain the substantially planar orientation of the slab top surface. All six hydraulic ram arms 450 serve to rotate the plate/slab mass, and secure the mass during transport. Plate 480 and central spine 420 strength and thickness are determined by the need to offset downward gravity deflection or sag to within hundredths of an inch increments. The hydraulic arms 450 on one side of the central spine 420 which function only in a vertical axis are joined to the central spine 420 by a rigid support bar 422, FIG. 17A. The hydraulic arms 450 on the other side of the central spine 420 pivot within a vertical plane in relation to the carrier. This combination is critical to avoid slab displacement.

Figure 17:
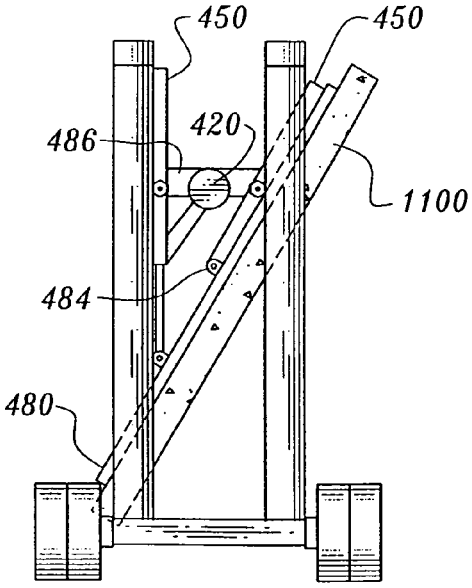
FIG. 17 is an end view of an embodiment of replacement slab carrier transport trailer depicted in FIG. 14 in travel mode.
Figure 17A:
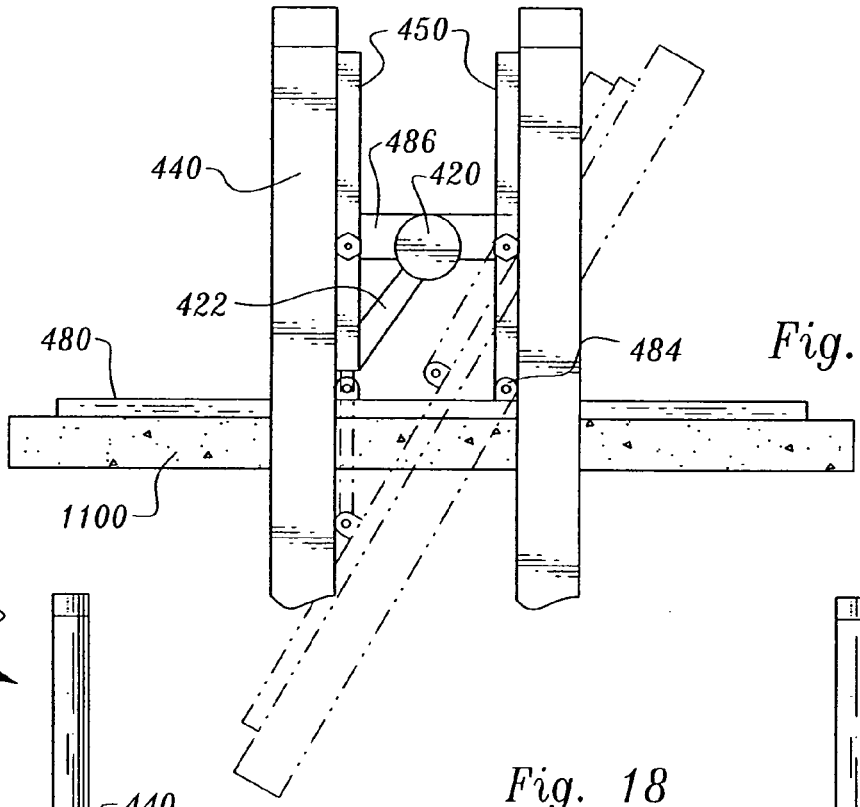
FIG. 17A is a detail of the rotating mechanism of the carrier transport trailer of FIGS. 14-17.

Another embodiment of the present invention comprises additional fixed non-hydraulic arm members 422 attached to the central support spine on one end and pivotally joined or anchored to the carrier plate on the other end, FIGS. 17 and 17A. In this embodiment, rigid support bars 422 may not be necessary.

The ends of the central support spine 420 attach to and are supported by mechanically controlled, height adjustable framed front and back carrier support mechanisms, 430 and 440. One embodiment of the mechanism means for the replacement slab 1100 comprises a fixed worm screw threaded assembly with cross beams 486 affixed to the central support spine 420. Alternatively, the mechanism means 450 for rotating the replacement slab 1100 comprises cable or rope and pulleys.

Figure 18:
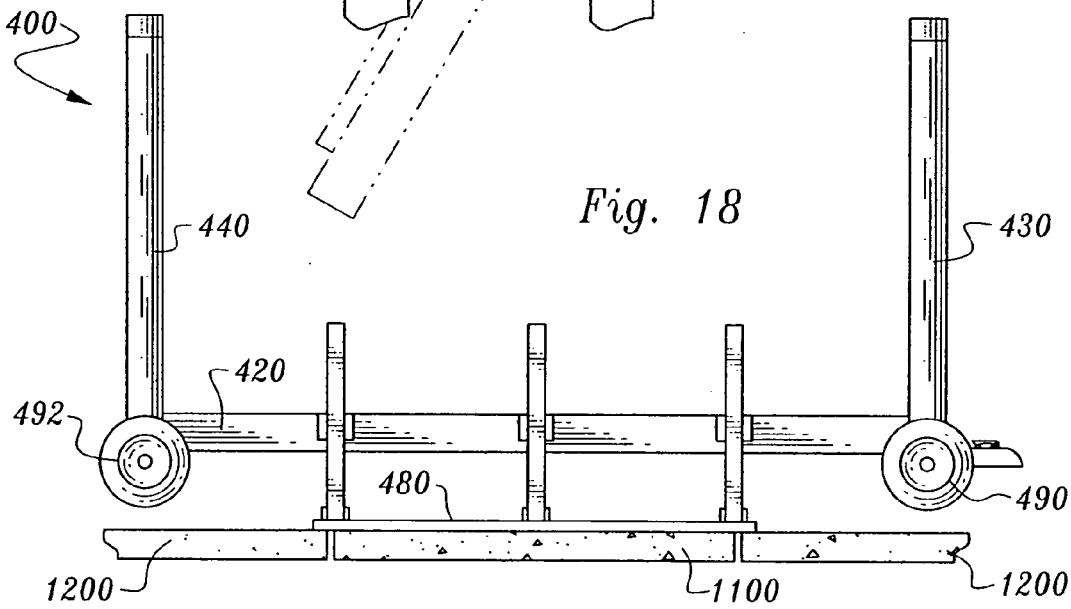
FIG. 18 is a side view of an embodiment of replacement slab carrier transport trailer depicted in FIGS. 14-17A in slab replacement mode wherein the carrier wheels are off the ground and the full weight of the carrier, plate, and slab is available to counter uplift from fluid binder material deemed necessary to provide even, complete, and uniform distribution of the binder material interface.
Figure 19:
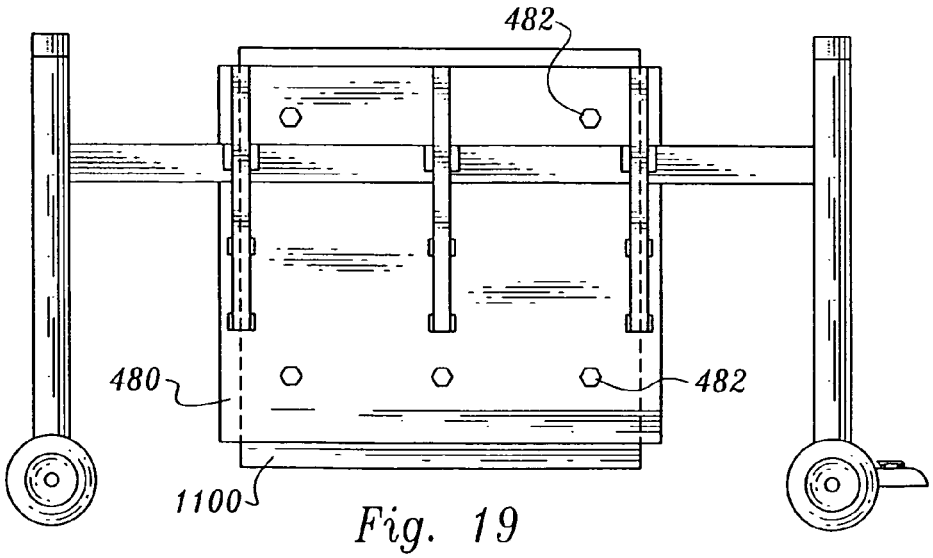
FIG. 19 is a side view of an embodiment of replacement slab carrier transport trailer of depicted in FIGS. 14-17A in travel mode.

As depicted by the embodiment of carrier or transport trailer 400 in FIGS. 17 and 18, when the carrier transport trailer 400 is in travel or transport mode, the mechanically controlled, front and back carrier support and height adjustable mechanisms, 430 and 440, are fully extended, and the cross-beams 486 and central support spine 420 are at a height of approximately 9 feet. Each carrier support mechanism, 430 and 440, further comprises two ends. One carrier support mechanism end comprises an axle and wheel assembly, 490 for the front wheel assembly or 492 for the rear wheel assembly. The other carrier support mechanism end comprises fixed attachment to one end or the other end of the central support spine 420. The front wheel assembly 490 further comprises a turning axle and tongue 498 which communicates with a tractor/truck transport means.

Figure 16:
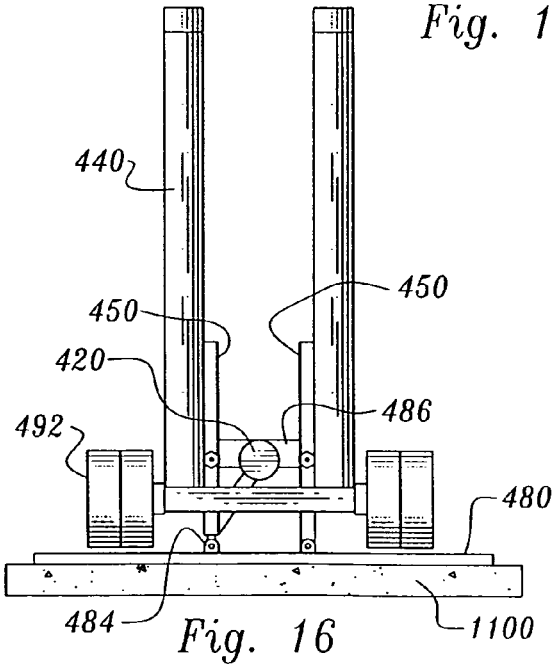
FIG. 16 is an end view of an embodiment of replacement slab carrier transport trailer depicted in FIG. 14 in slab replacement mode.

In the replacement slab 1100 placement mode, FIGS. 15, 16, and 18, the carrier transport trailer 400 is positioned above the location for the slab replacement. The replacement slab 1100 has been first rotated to an approximate horizontal position and then lowered into the location for the slab replacement by the corresponding mechanism means for lowering/lifting 450 the replacement slab 1100. Corresponding lowering of the central support spine 420 by the carrier support mechanisms, 430 and 440, allows the front wheel assembly 490 and the rear wheel assembly 492 to raise off the ground whereby the entire carrier transport trailer 400 weight is transmitted to, and is positioned on, the support plate 480, FIGS. 16 and 18. The support plate 480 extends approximately one foot on each end of the slab length onto the planar surface of existing slabs 1200 in the highway in this placement mode, FIG. 18. The plate extension dimension or plate thickness can be adjusted as necessary depending on the requirement to minimize slab sag or deflection.

Figure 22:
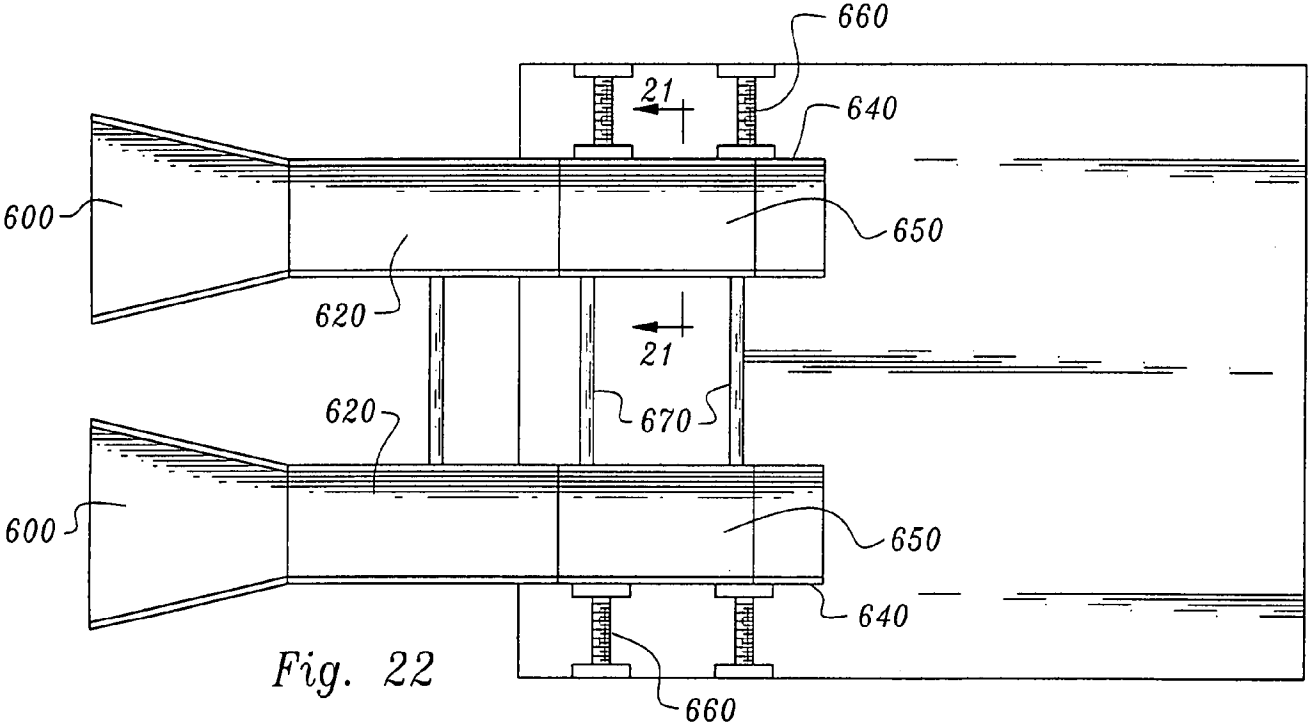
FIG. 22 is a top view of the guide ramp assembly of FIG. 20.
Figure 25:
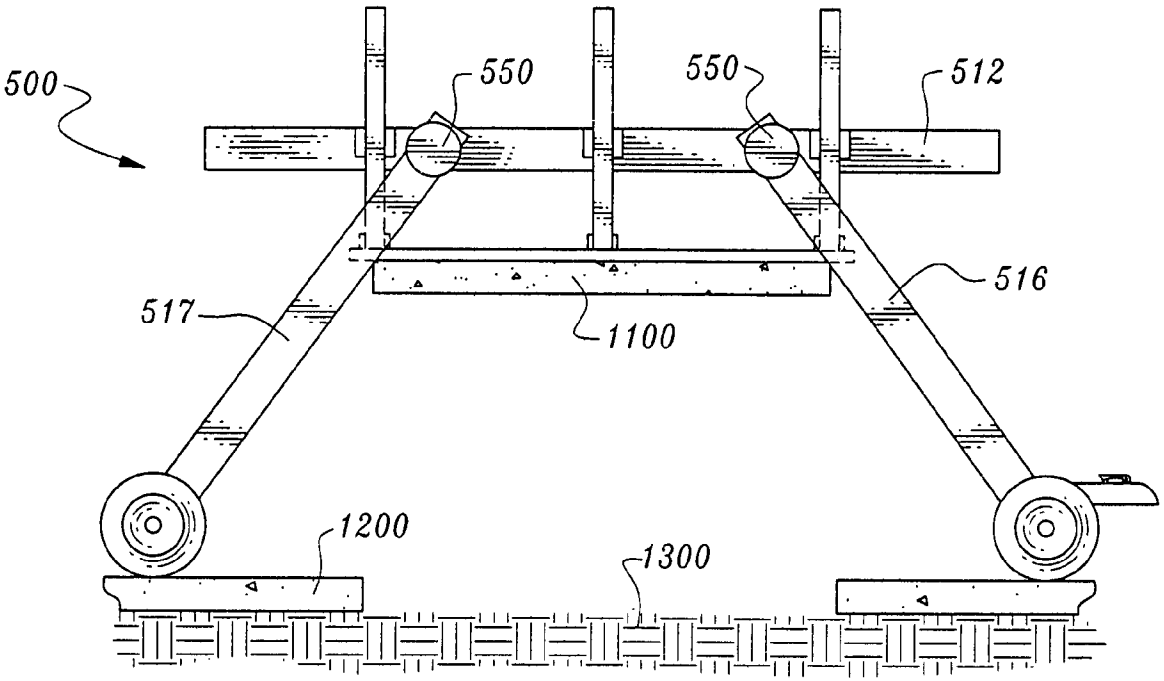
FIG. 25 is a side view of an embodiment of replacement slab carrier transport trailer of the present invention in slab replacement mode.

Embodiments of carrier transport trailer 400 depicted in FIGS. 14-19, or 500 depicted in FIGS. 25 and 25, can be positioned into the hole to receive the replacement slab 1100 using guide ramp assemblies as depicted in FIGS. 20-22, as similarly discussed above.

The guide ramps, FIG. 20, comprises an approach ramp 600 connectively hinged 610 to a ramp base 620, the height of which is adjustably fitted according to the hole depth with steel pads 630, if necessary. The ramp base 620 communicates with two equal sized and angled ramps 640 which, as depicted in FIG. 22, have equal sized channels 650 which correspond with the tire widths of the front 490 and rear 492 wheel assemblies of the carrier transport trailer 400. As shown in FIG. 22, the ramps 640 are spaced to receive the wheel assembly dimensions by fixed distance attachments 670 attached to the corresponding ramp inner sides, and are secured into position by use of manually adjusted screw or similar securing mechanisms 660 between the ramp outer sides and adjacent existing slabs 1200. The maximum width of the secured ramps 650 is approximately twelve feet, or adjustably to the particular replacement hole width dimension.

If time is of the essence, the present repair system can be used for concrete slab replacement by using plates and the carrier only without the injection guide collars and use of eye adjustment of the slab into place as practiced in the art.

Figure 26:
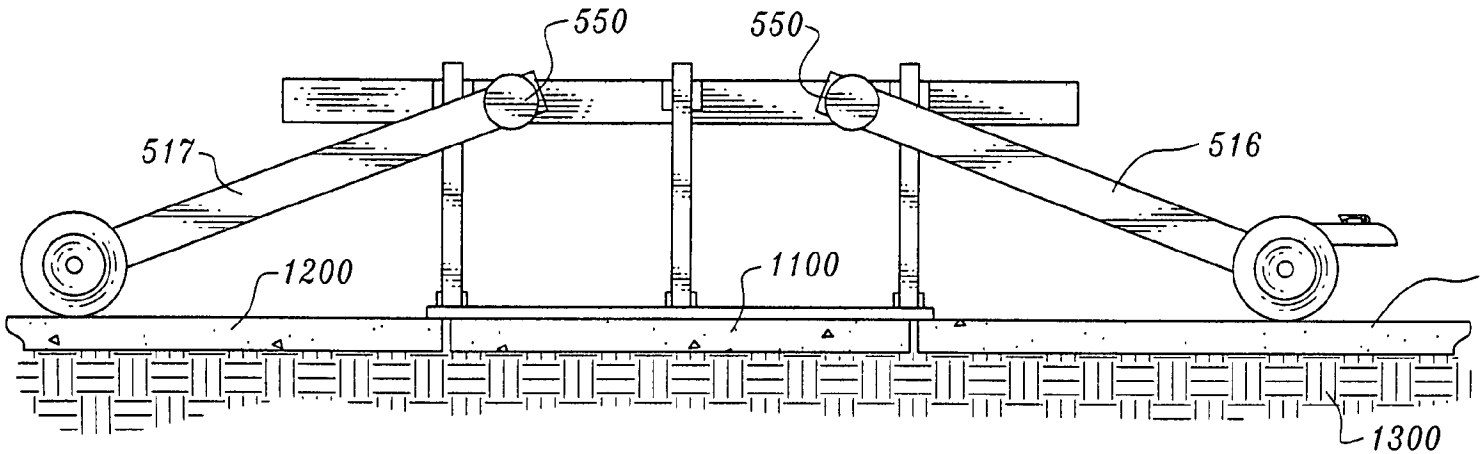
FIG. 26 is a side view of an embodiment of replacement slab carrier transport trailer depicted in FIG. 25 in slab replacement mode wherein the carrier wheels extend outward from the plate/slab assembly lowering the carrier frame and transferring substantially most of the full weight of the carrier to the plate/slab assembly to counter uplift from the grout pressure to provide even, complete, and uniform distribution of the grout layer interface.
Figure 27:
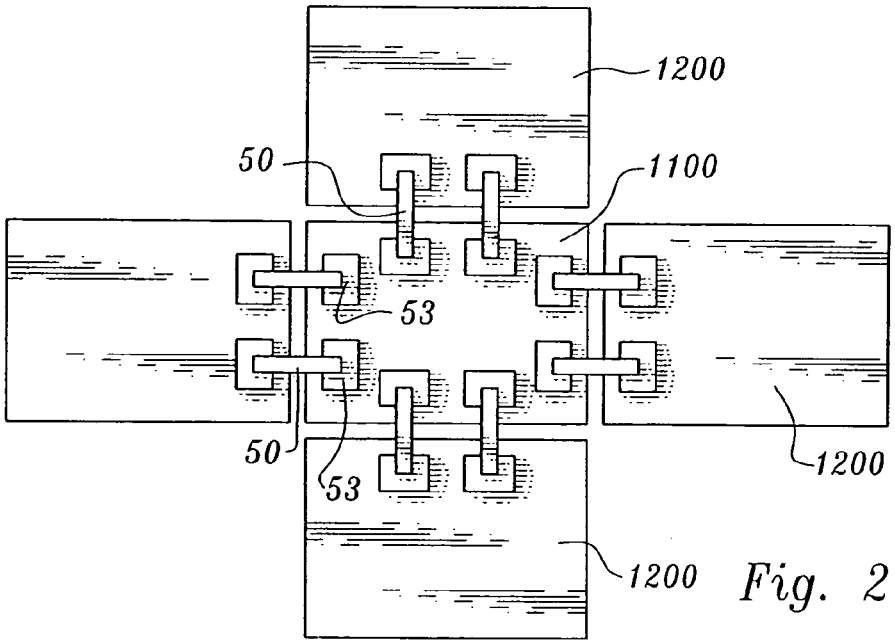
FIG. 27 is a top view of an alternative embodiment of bridge slab replacement apparatus of the present invention showing a cross-member, extension arm assembly.
Figure 28:
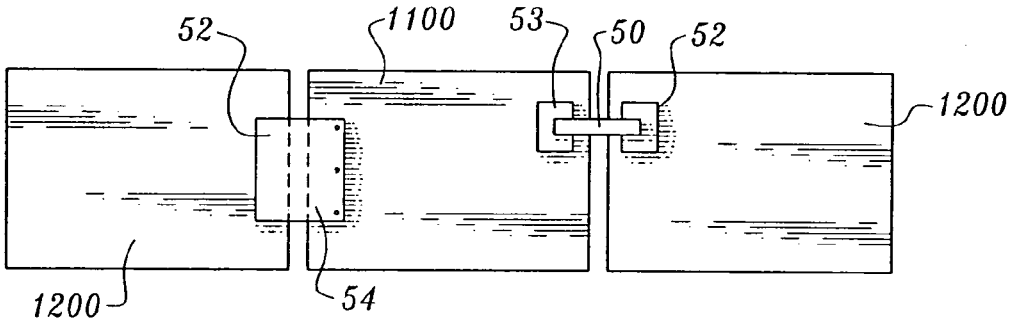
FIG. 28 is a top view of another embodiment of bridge slab replacement apparatus of the present invention showing alternative sizing and anchoring points for bridge plates.

The embodiments of carrier transport trailer 400 depicted in FIGS. 14-19, and 500 in FIGS. 25 and 26 are designed to use a preferred embodiment of collar plate 700, as depicted in FIG. 23, for precisely guided placement of a replacement concrete slab 1100 within the space bounded by unaffected surrounding concrete slab 1200 planar top surfaces. The collar plate 700 comprises at least one raised slot bar 710 for the side collar 68 and collar extensions 720 to engage and move in or out to accommodate varying widths of replacement slab 1100. The slot bar 710 serves to secure the collar extensions by vertically oriented bolts (not shown) built into the slot bar which are turned to secure the collar extension position once the side collar 68 is snugly positioned at the edge of the replacement slab 1100. The collar plate top side further comprises a plurality of slots 730 to allow movement and support for the end collar 68 and collar extensions 720 to accommodate varying lengths of replacement slab 1100. The collar 68 is under the collar plate 700 and extends nearly the slab width. The collar extensions 720 fit over and onto the collar 68 and fit into slots in the corresponding bar on the collar plate 700 top side, which hold the support collar 68 and extensions 720 below the plate so as to engage the replacement slab 1100. The collar plate 700 corners 750, provide spacial flexibility for differing sized collar add-in portions 760 to accommodate varying replacement slab 1100 sizes and are linked by removable bridges block-to-block 770 to the plate 700 and/or fixed collars, 68 to counter replacement slab uplift from the injection of high strength grout or polymeric foam. In this manner, the collar plate 700 provides a sealing means to hold pressurized high strength grout or polymeric foam in place until high strength grout or polymeric foam has been uniformly and evenly distributed under the replacement slab. Additionally, the adjustable collar plate 700 can be used to inject high strength grout or polymeric foam from the replacement slab 1100 perimeter, or using the same mechanism in reverse, to verify whether high strength grout or polymeric foam has reached the replacement slab 1100 perimeter, or measure and control fluid binding material pressure density from the replacement slab 1100 perimeter.

As depicted in FIG. 23A, the collar 68 cross-sectional view shows the collar portion which snugly fits against the replacement slab to be the base of an approximate right triangle collar cross-sectional geometry. In this manner, as the replacement slab is positioned into the space vacated by the removed damaged concrete slab, the hypotenuse side serves to guide the slab into the space while keeping the collar 68 snug against the replacement slab sides within the desired width dimension of the joint gap, 69. The collar 68 provides vertical oriented openings 68*a* for injection of fluid binding material and/or taking pressure measurements of the same.

Both the end and side collars 68 of the collar guide plate of FIG. 23 are shorter to the corresponding length and width dimensions of the replacement slab 1100. The side collar 68 and its corresponding extension 720 is much shorter because replacement slabs in the United States range from 12 feet to 16 feet in length. The varying lengths are designed to prevent harmonic vibrations which have been shown to be transferred to vehicles causing the vehicles to skitter off the highway surface. U.S. replacement slab widths approximate 12 feet; however, widths typically vary by inches, not feet.

Another embodiment of transport trailer 500, FIGS. 25 and 26, comprises a horizontal cross member 550 hinged to the top portion of each of the front frame member 516 and rear frame member 517. In this fashion, the support beam 512 is hinged to each frame member by attachment to the cross members 550. Front 516 and rear 517 frame member heights are controllably adjusted by hydraulically controlled pivot mechanisms allowing each frame member bottom portion to extend independently outward from the carrier plate, horizontally along the frame longitudinal axis, thus transferring most of the frame carrier or transport trailer weight to the carrier plate when the replacement slab has been positioned for installation.

The present invention uses a large, bob-tail type truck with a 5 to 7 ton crane and a high strength grout or polymeric foam storage, stirring or mixing, and pressurized applicator mechanism mounted thereon. All bridge removal plates, collars, ramps, saws, and other components or tools needed for the apparatus and system of the present invention including, but not limited to, bar code readers, global satellite positioning instruments, grout pressure measuring devices, and the like, would likewise be contained on this truck.

The apparatus and system of the present invention can remove and replace a failed concrete surface slab in about three hours; the methods in the art typically require eight to ten hours. The apparatus and system of the present invention can remove and replace a failed concrete surface slab with fewer laborers and less equipment. The present invention does not damage the supporting road base and provides a superior means to apply the interface high strength grout or polymeric foam. This improved slab replacement apparatus and system creates a smoother slab to slab vehicle ride and longer installed slab life—all at a reduced cost to remove and replace the failed concrete slab. And, most critically to the longevity of replacement slabs, the present invention addresses the need for precision repair work in replacing pre-cast concrete slabs in highways by insuring uniformity of: (i) grout density and distribution in the interface between the replacement slab and the roadbed; and (ii) the spacing tolerances between replacement slab and adjacent unaffected planar slab surfaces and boundaries up to the space vacated by the removed broken slab.

With respect to the above description then, it is to be realized that the optimum dimensional relationships for the components of the invention, to include variations in size, materials, shape, form, function and manner of operation, assembly, manufacture, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Additionally, since numerous modifications and changes will readily occur to those skilled in the art, it is not desired to limit the invention to the exact construction and operation shown and described, and further, all suitable modifications and equivalents may be resorted to, falling within the scope of the invention.

I claim:

1. A system for concrete surface repair comprising, in combination:

means to cut at least one broken concrete slab having a uniformly planar top surface into quarter sections without affecting existing concrete surfaces surrounding the broken slab;

means for removing at least one broken concrete slab in four lifts or less from a space bounded by unaffected surrounding concrete surfaces having a substantially uniform planar surface without impact to the underlying roadbed;

means for transporting at least one replacement concrete slab having a uniformly planar top surface and a longitudinal axis;

means for placing at least one replacement concrete slab having a uniformly planar top surface into position above the space bounded by unaffected surrounding concrete surfaces;

means for guiding at least one replacement concrete slab having a uniformly planar top surface into the space bounded by unaffected surrounding concrete surfaces;

means to inject fluid binding material between the roadbed and at least one replacement slab;

means to control replacement slab uplift during fluid binding material injection; and means to ensure planar uniformity between at least one replacement slab having a uniformly planar top surface and the planar surfaces of unaffected surrounding concrete surfaces.

2. The system of claim 1, wherein means to cut at least one broken concrete slab having a uniformly planar top surface into quarter sections without affecting existing concrete surfaces surrounding the broken slab comprises:

cutting means selected from the group consisting of at least one: circular saw means, jig saw means, laser saw means, and water jet saw means;

global positioning control means for controllably directing cutting action of each saw;

bar code means for identifying at least one cut slab and locating its position within the roadway using global positioning means; and microprocessor means for recording the global positioning coordinates and bar code identification of at least one cut slab before it is removed from a space bounded by unaffected surrounding concrete surfaces.

3. The system of claim 1, wherein means for removing at least one broken concrete slab in four lifts or less from a space bounded by the unaffected surrounding concrete surfaces without impact to the underlying roadbed comprises:

a plate of solid material comprising a predetermined geometry, uniform thickness, plate edge boundaries, a planar plate top surface and a planar plate bottom surface, wherein the plate can support weights up to five tons;

a plurality of holes of uniform diameter through the plate, wherein each hole diameter defines a centerline perpendicular to the plate planar top and bottom surfaces;

a plurality of crane pick points on the plate edge boundaries;

means for anchoring the plate bottom planar surface flush to the top planar surface of at least one broken concrete slab quarter section through the plate holes; and lifting crane mechanism means attached to selectively predetermined crane pick points.

4. The system of claim 3, wherein the plate further comprises:

a rectangular geometry having four corners;

a one-to-one ratio of holes to solid plate material; and one crane pick point at each plate corner.

5. The system of claim 3, wherein the plate further comprises one or more crane pick points located on the plate top planar surface at predetermined positions interior from the plate edge boundaries.

6. The system of claim 3, wherein means for anchoring the plate bottom planar surface flush to the top planar surface of at least one broken concrete slab quarter section further comprises at least one expanding deadbolt threaded receiver positioned through at least one predetermined plate hole into the slab quarter section and at least one corresponding threaded bolt insertably positioned through each predetermined hole and received by the expanding deadbolt threaded receiver.

7. The system of claim 3, wherein the plate solid material is selected from the group consisting of metal, high strength poly-carbon, and other suitable materials thick and strong enough to support weights of approximately 5 tons.

8. The system of claim 1, wherein means for transporting at least one replacement concrete slab comprises, in combination:

a frame capable of supporting replacement concrete slabs weighing approximately 25,000 pounds and having a longitudinal frame axis, comprising a front frame member having a top portion and bottom portion, a rear frame member having a top portion and a bottom portion, and a main support beam member connecting the front frame member and rear frame member by attachment to the top frame member portions, wherein the support beam comprises a top surface, a bottom surface, and two side surfaces;

wheel mounting members pivotally joined to the front frame member bottom portion;

wheel mounting members fixedly joined to the rear frame member bottom portion;

a tongue projecting forward from and joined to the wheel mounting members connected to the front frame member bottom portion;

wheels rotatably disposed on the wheel mounting members; and means to rotate, lower and raise, and fixedly secure at least one replacement concrete slab within the frame.

9. The system of claim 8, wherein means to rotate, lower and raise, and fixedly secure at least one replacement concrete slab having a uniformly planar top surface within the frame further comprises, in combination:

at least four hoist chains, each chain having two ends;

mechanical hoist linkage means joined to the main support beam and interconnecting the main support beam and one end of each hoist chain, wherein at least two hoist chains are oppositely opposed on either side of the main support beam, and wherein mechanical hoist linkage means provides separate controlled movement of each chain;

at least one attachment pick point attached to each chain end not affixed to mechanical hoist linkage means, wherein at least four attachment pick points are axially aligned on the replacement concrete slab planar top surface perpendicular to the replacement slab longitudinal axis such that engagement of mechanical hoist linkage means controllably rotates the replacement concrete slab planar top surface from a substantially horizontal position about its longitudinal axis, whereby the rotated replacement concrete slab fits within the frame width; and at least four removable swing stabilizer bars insertably positioned into the frame members as corresponding pairs between the wheel mounting members and the main support beam member once the replacement concrete slab has been fully rotated, wherein the inserted stabilizer bars project rearwards perpendicularly from the front frame member and the inserted stabilizer bars project forward perpendicularly from the rear frame member, and wherein the rotated replacement slab fits between corresponding inserted stabilizer bar pairs during transport of the replacement slab; wherein the main support beam member is fixedly attached to the top frame member portions; and wherein the frame height is approximately twelve feet, the frame length is approximately twenty-six feet, and the frame width is approximately seven and one half feet.

10. The system of claim 8, wherein means to rotate, lower and raise, and fixedly secure at least one replacement concrete slab having a uniformly planar top surface within the frame further comprises, in combination:

at least one carrier plate of solid material comprising a predetermined geometry, substantially uniform thickness, plate edge boundaries, a planar plate top surface, a planar plate bottom surface, and a longitudinal axis;

means to controllably raise or lower each carrier plate within the frame;

means to controllably rotate each carrier plate along its longitudinal axis within the frame;

attachment means whereby each carrier plate bottom surface is anchored flush to at least one replacement slab planar top surface; and means to controllably adjust frame member main support beam height.

11. The system of claim 10, wherein means to controllably rotate each carrier plate along its longitudinal axis within the frame comprises:

at least three pairs of ram drive means positioned along the main support beam member at predetermined locations, wherein each pair of drive means is fixedly located on opposite side surfaces of the main support beam member, wherein one of each pair of drives on the same main support beam member side surface controllably operates only vertically relative to the frame, and the corresponding drive on the opposite support beam side controllably operates in a vertical plane relative to the frame;

at least six hydraulic arm means, each arm means comprising two ends, wherein one arm means end is joined to and controlled by separate ram drive means and the other arm means end is pivotally joined to the carrier plate; and at least three rigid support bars, each bar comprising two ends, wherein one bar end is pivotally joined to hydraulic arm means operating only in a vertical direction by a rotating ram drive means and the other bar end is pivotally joined to the carrier main support member.

12. The system of claim 11, wherein means to controllably rotate each carrier plate along its longitudinal axis within the frame further comprises a heim joint located at ram drive means connected to the main support beam, and each hydraulic arm means has a heim joint at the carrier plate connection.

13. The system of claim 10, wherein means to controllably raise or lower each carrier plate within the frame comprises a horizontal cross member fixedly joined to the top portion of each frame member, wherein the main support beam member is fixedly joined to each frame member by attachment to the cross members, and wherein means to controllably adjust frame main support beam member height comprises mechanism means in the front frame member and the rear frame member selected from the group consisting of at least one: vertical worm screw means, rope and pulley means, and cable and pulley means.

14. The system of claim 13, wherein means to control replacement slab uplift during fluid binding material injection and means to ensure planar uniformity between at least one replacement slab and the unaffected surrounding concrete surfaces comprise adjusting front and rear frame members heights until all wheels are off the ground, wherein the entire frame weight is transferred to the replacement slab top surface, and wherein the carrier plate extends to unaffected surrounding concrete surfaces.

15. The system of claim 10, wherein means to controllably raise or lower each carrier plate within the frame comprises a horizontal cross member hinged to the top portion of each frame member, wherein the frame main support beam is hinged to each frame member by attachment to the cross members, and wherein means to controllably adjust frame main support beam member height comprise pivot means whereby each frame member bottom portion to extends independently outward from the carrier plate horizontally along the frame longitudinal axis.

16. The system of claim 15, wherein means to control replacement slab uplift during fluid binding material injection and means to ensure planar uniformity between at least one replacement slab and the unaffected surrounding concrete surfaces comprise front and rear frame members extending outward from the replacement slab, wherein substantially all of the frame weight is transferred to the replacement slab top surface, and wherein the carrier plate extends to unaffected surrounding concrete surfaces.

17. The system of claim 10, wherein means for guiding at least one replacement concrete slab having a uniformly planar top surface into the space bounded by unaffected surrounding concrete surfaces comprises:

at least one replacement concrete slab comprising a planar top surface of rectangular geometry defining slab side boundary edges, four corners, a predetermined uniform thickness, a predetermined length dimension, a predetermined width dimension, and means to identify the replacement slab with respect to placement of the replacement slab within a previously identified space in an existing concrete surface;

a plurality of adjustable and detachable slab collar members surrounding the slab side boundary edges;

adjustable and detachable slab collar members surrounding the slab corners;

rectangular carrier plate geometry comprising, four corners, a predetermined uniform thickness, a predetermined length dimension which is slightly longer than the length of the replacement slab, and a predetermined width dimension which is slightly shorter than the width of the replacement slab;

means to fixedly attach adjustable and detachable slab collar members surrounding the slab side boundary edges to the carrier plate;

means to fixedly attach adjustable and detachable slab collar members surrounding the slab corners to the means to fixedly attach adjustable and detachable slab collar members surrounding the slab side boundary edges to the carrier plate; and global satellite positioning control means to position the carrier plate.

18. The system of claim 17, wherein means to fixedly attach adjustable and detachable slab collar members surrounding the slab side boundary edges to the carrier plate comprises:

four uniform collars each comprising a top surface of predetermined width having a longitudinal axis, inside and outside surfaces of predetermined height which end at a tapered squared-off collar bottom, a cross-sectional geometry defining a vertical side attached at right angles to the top and bottom sides which join a tapered side, a plurality of extension arms equidistantly spaced along the collar inside surfaces extending inwards from the surfaces perpendicular to the collar longitudinal axis, wherein two longer collars have uniform lengths slightly shorter than corresponding replacement slab length dimension, and wherein the other two shorter collars have uniform lengths slightly shorter than corresponding replacement slab width dimension;

two uniform slot bars fixedly attached to the carrier plate top side, parallel to the carrier plate long side, and comprising a plurality of slots sized to receive and hold collar extension arms so that the longer collar inside surfaces communicate with the replacement slab length boundaries, wherein one slot bar is set at a predetermined distance from one carrier plate long side and the other slot bar is set at an equal distance from the other carrier plate long side;

two uniform sets of a plurality of slots in carrier plate short sides, wherein each slot has uniform cross-sectional geometries defining a slot centerline, wherein each set of slots comprises the same number of slots on each carrier plate short side, wherein slot center-lines are perpendicular to the carrier plate short side, wherein the alignment of slot center-lines on the carrier plate short side are equidistant and linear, and wherein the slots are sized to receive and hold collar extension arms so that the shorter collar inside surfaces communicate with the replacement slab width boundaries.

19. The system of claim 18, wherein means to inject fluid binding material between the roadbed and at least one replacement slab comprises:

replacement slab with a bottom surface comprising precast flow channels, at least one injection port on the slab top surface through the slab thickness and exiting on the slab bottom surface within a flow channel; and four corner collars bridging the space between shorter and longer collars on the replacement plate corners.

20. The system of claim 19, wherein means to inject fluid binding material between the roadbed and at least one replacement slab further comprises at least one injection port in a replacement slab collar member.

21. The system of claim 20, wherein means to identify the replacement slab with respect to placement of the replacement slab within a previously identified space in an existing concrete surface comprises:

bar code identification of at least one replacement slab stored in means for microprocessor data storage and access;

correlation of bar code identification for at least one replacement slab with global satellite positioning coordinates for the broken concrete slab removed from a space bounded by unaffected surrounding concrete surfaces by microprocessor means; and wireless transmission means to communicate a plurality of data selected from the group consisting of at least: bar code identification for at least one replacement slab and global satellite positioning coordinates for positioning the replacement slab into the space vacated by the removed broken concrete slab, to means for guiding at least one replacement concrete slab into the space bounded by unaffected surrounding concrete surfaces.

22. The system of claim 10, wherein means to control replacement slab uplift during fluid binding material injection and means to ensure planar uniformity between at least one replacement slab and the unaffected surrounding concrete surfaces comprises:

at least one bridge plate of solid material comprising a predetermined geometry, uniform thickness, a planar plate top surface, a planar plate bottom surface, and a plurality of slots through the bridge plate, wherein the bridge plate bottom surface can be fixedly attached to a replacement slab top surface positioned in the space bounded by unaffected surrounding concrete surfaces with a portion of the bridge plate planer bottom surface extending to and communicating with unaffected surrounding concrete surfaces;

attachment means whereby at least one bridge plate bottom surface can be fixedly attached to a replacement slab top surface positioned in the space bounded by unaffected surrounding concrete surfaces through the slots through the bridge plate; and at least one support weight affixed to the bridge plate top surface corresponding to the bridge plate planer bottom surface extending to and communicating with unaffected surrounding concrete surfaces.

23. The system of claim 10, wherein means to control replacement slab uplift during fluid binding material injection and means to ensure planar uniformity between at least one replacement slab and the unaffected surrounding concrete surfaces comprises:

at least one cross collar assembly comprising a solid central body, a plurality of slots through the central body, at least four pair of equal sized, extendable bridge forks, wherein one pair of bridge forks extend from the collar central body in ninety degree orientation to adjacent bridge fork pairs such that the collar provides bridge fork extension over a 360 degree range in ninety degree increments, and wherein extending bridge fork ends further comprise a plate element which rests on top of unaffected surrounding concrete surfaces when the bridge forks are extended;

means for counter balancing weighted mass on the plate element of each extending bridge fork; and attachment means whereby at least one cross collar assembly is fixedly joined to a replacement slab top surface positioned in the space bounded by unaffected surrounding concrete surfaces through the slots through the cross collar.

24. The system of claim 10, wherein attachment means between the carrier plate and replacement slab further comprises:

a plurality of rectangular slots through the plate surface wherein each slot has a predetermined length and width dimension;

at least one expanding deadbolt threaded receiver positioned through at least one predetermined plate slot into the slab quarter section and at least one corresponding threaded bolt having a head insertably positioned through each predetermined hole and received by the expanding deadbolt threaded receiver wherein the bolt head diameter is larger than the corresponding slot width.

25. The system of claim 8, wherein means for placing at least one replacement concrete slab having a uniformly planar top surface into position above the space bounded by unaffected surrounding concrete surfaces comprises at least one guide ramp assembly comprising:

an approach lip with a beveled end and a hinged end wherein the angle of the ramp relative to surrounding concrete surfaces is adjustable;

a pair of ramps, each ramp having a channel, an outside edge, and inside edge, a ramp top, and a ramp bottom defining a predetermined uniform angle of declination from surrounding concrete surfaces, wherein the ramps are fixedly attached at a predetermined distance by at least two uniform cross members affixed to the ramp inside edges, wherein the ramps are aligned within the space bounded by unaffected surrounding concrete surfaces by manual adjustment means affixed to the ramp outside edges, and wherein the ramp channels and cross members are sized to receive replacement slab transporting means wheel dimensions;

at least one steel pad; and an approach support member having a first hinged end attached to the approach lip hinged end and a second hinged end attached to the ramp tops, a top side, and a bottom side, wherein the support member height is adjusted by placing at least one steel pad between the support member bottom side and unaffected concrete top planar surface.

26. Apparatus for cutting at least one broken concrete slab having a uniformly planar top surface into a plurality of sections without affecting existing planar concrete surfaces surrounding the broken concrete slab comprising:

cutting means selected from the group consisting of at least one: circular saw means, jig saw means, laser saw means, and water jet saw means;

global positioning control means for controllably directing cutting action of each saw;

bar code means for identifying at least one cut slab and locating its position within the roadway using global positioning means; and microprocessor means for recording the global positioning coordinates and bar code identification of at least one cut slab before it is removed from a space bounded by unaffected surrounding concrete surfaces.

27. Apparatus for removing at least one segment of broken concrete slab cut according to the apparatus of claim 26 from a space bounded by unaffected surrounding concrete surfaces without impact to the underlying roadbed comprising:

a plate of solid material comprising a predetermined geometry, uniform thickness, plate edge boundaries, a planar plate top surface and a planar plate bottom surface, wherein the plate can support weights up to five tons;

a plurality of attachment means anchoring the planar plate bottom surface flush to the planar top surface of at least one segment of cut broken concrete slab;

a plurality of holes of uniform diameters through the plate, wherein each hole diameter defines a centerline perpendicular to the plate planar top and bottom surfaces;

a plurality of crane pick points on the plate edge boundaries; and lifting crane mechanism means attached to selectively predetermined crane pick points.

28. The plate apparatus of claim 27, further comprising:

rectangular plate geometry having four corners;

a one-to-one ratio of holes to solid plate material; and one crane pick point at each plate corner.

29. The plate apparatus of claim 27, further comprising one or more crane pick points located on the plate top planar surface at predetermined positions interior from the plate edge boundaries.

30. The plate apparatus of claim 27, wherein attachment means for anchoring the plate bottom planar surface flush to the top planar surface of at least one broken concrete slab quarter section further comprises at least one expanding deadbolt threaded receiver positioned through at least one predetermined plate hole into the slab quarter section and at least one corresponding threaded deadbolt insertably positioned through each predetermined hole and received by the expanding deadbolt threaded receiver.

31. The plate apparatus of claim 27, wherein the plate solid material is selected form the group consisting of metal, high strength poly-carbon, and other suitable materials thick and strong enough to support weights of approximately 5 tons.

32. Apparatus for transporting at least one replacement concrete slab having a uniformly planar top surface and a longitudinal axis to the space created by the apparatus of claim 27 and bounded by unaffected surrounding concrete surfaces without impact to the underlying roadbed comprising:

a frame capable of supporting replacement concrete slabs weighing approximately 25,000 pounds and having a longitudinal frame axis, comprising a front frame member having a top portion and bottom portion, a rear frame member having a top portion and a bottom portion, and a main support beam member connecting the front frame member and rear frame member by attachment to the top frame member portions, wherein the support beam comprises a top surface, a bottom surface, and two side surfaces;

wheel mounting members pivotally joined to the front frame member bottom portion;

wheel mounting members fixedly joined to the rear frame member bottom portion;

a tongue projecting forward from and joined to the wheel mounting members connected to the front frame member bottom portion;

wheels rotatably disposed on the wheel mounting members;

means to fixedly secure at least one replacement concrete slab within the frame; and means for placing at least one replacement concrete slab having a uniformly planar top surface into position above the space bounded by unaffected surrounding concrete surfaces.

33. The transport apparatus of claim 32, wherein means to fixedly secure at least one replacement concrete slab having a uniformly planar top surface within the frame comprises:

at least four hoist chains, each chain having two ends;

mechanical hoist linkage means joined to the main support beam and interconnecting the main support beam and one end of each hoist chain, wherein at least two hoist chains are oppositely opposed on either side of the main support beam, and wherein mechanical hoist linkage means provides separate controlled movement of each chain;

at least one attachment pick point attached to each chain end not affixed to mechanical hoist linkage means, wherein at least four attachment pick points are axially aligned on the replacement concrete slab planar top surface perpendicular to the replacement slab longitudinal axis such that engagement of mechanical hoist linkage means controllably rotates the replacement concrete slab planar top surface from a substantially horizontal position about its longitudinal axis, whereby the rotated replacement concrete slab fits within the frame width;

at least four removable swing stabilizer bars insertably positioned into the frame members as corresponding pairs between the wheel mounting members and the main support beam member once the replacement concrete slab has been fully rotated, wherein the inserted stabilizer bars project rearwards perpendicularly from the front frame member and the inserted stabilizer bars project forward perpendicularly from the rear frame member;

wherein the rotated replacement slab fits between corresponding inserted stabilizer bar pairs during transport of the replacement slab;

wherein the main support beam member is fixedly attached to the top frame member portions; and wherein the frame height is approximately twelve feet, the frame length is approximately twenty-six feet, and the frame width is approximately seven and one half feet.

34. The transport apparatus of claim 32, wherein means to fixedly secure at least one replacement concrete slab having a uniformly planar top surface within the frame comprises:

at least one carrier plate of solid material comprising a predetermined geometry, substantially uniform thickness, plate edge boundaries, a planar plate top surface, a planar plate bottom surface, and a longitudinal axis;

means to controllably raise or lower each carrier plate within the frame;

means to controllably rotate each carrier plate along its longitudinal axis within the frame;

attachment means whereby each carrier plate bottom surface is anchored flush to at least one replacement slab planar top surface;

means to controllably adjust frame main support beam member height;

means to control replacement slab uplift during fluid binding material injection; and means to ensure planar uniformity between at least one replacement slab and the unaffected surrounding concrete surfaces.

35. The transport apparatus of claim 34, further comprising a horizontal cross member fixedly joined to the top portion of each frame member, wherein the main support beam member is fixedly joined to each frame member by attachment to the cross members, and wherein means to controllably adjust frame main support beam member height comprise mechanism means in the front frame member and the rear frame member selected from the group consisting of at least one: vertical worm screw means, rope and pulley means, and cable and pulley means.

36. The transport apparatus of claim 35, wherein means to control replacement slab uplift during fluid binding material injection and means to ensure planar uniformity between at least one replacement slab and the unaffected surrounding concrete surfaces comprise adjusting front and rear frame members heights until all wheels are off the ground, wherein the entire frame weight is transferred to the replacement slab top surface, and wherein the carrier plate extends to unaffected surrounding concrete surfaces.

37. The transport apparatus of claim 34, further comprising a horizontal cross member hinged to the top portion of each frame member, wherein the frame main support beam is hinged to each frame member by attachment to the cross members, and wherein means to controllably adjust frame main support beam member height comprise pivot means whereby each frame member bottom portion to extends independently outward from the carrier plate horizontally along the frame longitudinal axis.

38. The apparatus of claim 37, wherein means to control replacement slab uplift during fluid binding material injection and means to ensure planar uniformity between at least one replacement slab and the unaffected surrounding concrete surfaces comprise front and rear frame members extending outward from the replacement slab, wherein substantially all of the frame weight is transferred to the replacement slab top surface, and wherein the carrier plate extends to unaffected surrounding concrete surfaces.

39. The transport apparatus of claim 34, wherein means for placing at least one replacement concrete slab having a uniformly planar top surface into position above the space bounded by unaffected surrounding concrete surfaces comprises:

an approach lip with a beveled end and a hinged end wherein the angle of the lip relative to surrounding concrete surfaces is adjustable;

a pair of ramps, each ramp having a channel, an outside edge, and inside edge, a ramp top, and a ramp bottom defining a predetermined uniform angle of declination from surrounding concrete surfaces, wherein the ramps are fixedly attached at a predetermined distance by at least two uniform cross members affixed to the ramp inside edges, wherein the ramps are aligned within the space bounded by unaffected surrounding concrete surfaces by manual adjustment means affixed to the ramp outside edges, and wherein the ramp channels and cross members are sized to receive replacement slab transporting means wheel dimensions;

at least one steel pad; and an approach support member having a first hinged end attached to the approach lip hinged end and a second hinged end attached to the ramp tops, a top side, and a bottom side, wherein the support member height is adjusted by placing at least one steel pad between the support member bottom side and unaffected concrete top planar surface.

40. The apparatus of claim 34, wherein means to control replacement slab uplift during fluid binding material injection and means to ensure planar uniformity between at least one replacement slab and the unaffected surrounding concrete surfaces comprises:

at least one bridge plate of solid material comprising a predetermined geometry, uniform thickness, a planar plate top surface, a planar plate bottom surface, and a plurality of slots through the bridge plate, wherein the bridge plate bottom surface can be fixedly attached to a replacement slab top surface positioned in the space bounded by unaffected surrounding concrete surfaces with a portion of the bridge plate planer bottom surface extending to and communicating with unaffected surrounding concrete surfaces;

attachment means whereby at least one bridge plate bottom surface can be fixedly attached to a replacement slab top surface positioned in the space bounded by unaffected surrounding concrete surfaces through the slots through the bridge plate; and at least one support weight affixed to the bridge plate top surface corresponding to the bridge plate planer bottom surface extending to and communicating with unaffected surrounding concrete surfaces.

41. The transport, apparatus of claim 34, wherein means to control replacement slab uplift during fluid binding material injection and means to ensure planar uniformity between at least one replacement slab and the unaffected surrounding concrete surfaces comprises:

at least one cross collar assembly comprising a solid central body, a plurality of slots through the central body, at least four pair of equal sized, extendable bridge forks, wherein one pair of bridge forks extend from the collar central body in ninety degree orientation to adjacent bridge fork pairs such that the collar provides bridge fork extension over a 360 degree range in ninety degree increments, and wherein extending bridge fork ends further comprise a plate element which rests on top of unaffected surrounding concrete surfaces when the bridge forks are extended;

means for counter balancing weighted mass on the plate element of each extending bridge fork; and attachment means whereby at least one cross collar assembly is fixedly joined to a replacement slab top surface positioned in the space bounded by unaffected surrounding concrete surfaces through the slots through the cross collar.

42. The apparatus of claim 34, wherein attachment means between the carrier plate and replacement slab further comprises:

a plurality of rectangular slots through the plate surface wherein each slot has a predetermined length and width dimension;

at least one expanding deadbolt threaded receiver positioned through at least one predetermined plate slot into the slab quarter section and at least one corresponding threaded bolt having a head insertably positioned through each predetermined hole and received by the expanding deadbolt threaded receiver wherein the bolt head diameter is larger than the corresponding slot width.

43. The transport apparatus of claim 32, wherein means to controllably rotate each carrier plate along its longitudinal axis within the frame comprises:

at least three pairs of ram drive means positioned along the main support beam member at predetermined locations, wherein each pair of drive means is fixedly located on opposite side surfaces of the main support beam member, wherein one of each pair of drives on the same main support beam member side surface controllably operates only vertically relative to the frame, and the corresponding drive on the opposite support beam side controllably operates in a vertical plane relative to the frame;

at least six hydraulic arms, each arm comprising two ends, wherein one arm end is joined to and controlled by separate ram drive means and the other arm end is pivotally joined to the carrier plate; and at least three rigid support bars, each bar comprising two ends, wherein one bar end is pivotally joined to a hydraulic arm operating only in a vertical direction by a rotating ram drive means and the other bar end is pivotally joined to the carrier main support member.

44. The apparatus of claim 43, wherein each ram drive means further comprises a heim joint located at ram drive means connected to the main support beam, and each hydraulic arm means has a heim joint at the carrier plate connection.

45. The transport apparatus of claim 32, wherein means for placing at least one replacement concrete slab having a uniformly planar top surface into position above the space bounded by unaffected surrounding concrete surfaces comprises:

at least one replacement concrete slab comprising rectangular geometry defining slab side boundary edges, four corners, a predetermined uniform thickness, a predetermined length dimension, a predetermined width dimension, and means to identify the replacement slab with respect to placement of the replacement slab within a previously identified space in an existing concrete surface;

adjustable and detachable slab collar members surrounding the slab side boundary edges;

adjustable and detachable slab collar members surrounding the slab corners;

rectangular carrier plate geometry comprising, four corners, a predetermined uniform thickness, a predetermined length dimension which is slightly longer than the length of the replacement slab, and a predetermined width dimension which is slightly shorter than the width of the replacement slab;

means to fixedly attach adjustable and detachable slab collar members surrounding the slab side boundary edges to the carrier plate;

means to fixedly attach adjustable and detachable slab collar members surrounding the slab corners to the means to fixedly attach adjustable and detachable slab collar members surrounding the slab side boundary edges to the carrier plate; and global satellite positioning control means to position the carrier plate.

46. The slab positioning apparatus of claim 45, wherein means to fixedly attach adjustable and detachable slab collar members surrounding the slab side boundary edges to the carrier plate comprises:

four uniform collars each comprising a top surface of predetermined width having a longitudinal axis, inside and outside surfaces of predetermined height which end at a tapered collar bottom, a cross-sectional geometry defining a vertical side attached at right angles to the top and bottom sides which join a tapered side, a plurality of extension arms equidistantly spaced along the collar inside surfaces extending inwards from the surfaces perpendicular to the collar longitudinal axis, wherein two longer collars have uniform lengths slightly shorter than corresponding replacement slab length dimension, and wherein the other two shorter collars have uniform lengths slightly shorter than corresponding replacement slab width dimension;

two uniform slot bars fixedly attached to the carrier plate top side, parallel to the carrier plate long side, and comprising a plurality of slots sized to receive and hold collar extension arms so that the longer collar inside surfaces communicate with the replacement slab length boundaries, wherein one slot bar is set at a predetermined distance from one carrier plate long side and the other slot bar is set at an equal distance from the other carrier plate long side;

two uniform sets of a plurality of slots in carrier plate short sides, wherein each slot has uniform cross-sectional geometries defining a slot centerline, wherein each set of slots comprises the same number of slots on each carrier plate short side, wherein slot center-lines are perpendicular to the carrier plate short side, wherein the alignment of slot center-lines on the carrier plate short side are equidistant and linear, and wherein the slots are sized to receive and hold collar extension arms so that the shorter collar inside surfaces communicate with the replacement slab width boundaries.

47. The apparatus of claim 46, further comprising: at least one replacement slab with a substantially uniform slab thickness, a top surface, a bottom surface comprising precast flow channels, at least one injection port on the replacement slab top surface through the slab thickness and exiting on the slab bottom surface within a flow channel; and four corner collars bridging the space between shorter and longer collars on the replacement plate corners.

48. The apparatus of claim 47, further comprising at least one injection port in a replacement slab collar member.

49. The apparatus of claim 48, further comprising:

bar code identification of at least one replacement slab stored in means for microprocessor data storage and access;

correlation of bar code identification for at least one replacement slab with global satellite positioning coordinates for the broken concrete slab removed from a space bounded by unaffected surrounding concrete surfaces by microprocessor means; and wireless transmission means to communicate a plurality of data selected from the group consisting of at least: bar code identification for at least one replacement slab and global satellite positioning coordinates for positioning the replacement slab into the space vacated by the removed broken concrete slab, to means for guiding at least one replacement concrete slab into the space bounded by unaffected surrounding concrete surfaces.

50. A method of concrete highway surface repair, the method comprising the steps of:

providing the system of claim 1;

providing a highway surface with at least one failed or broken concrete slab;

identifying at least one broken concrete slab in the highway surface;

cutting at least one broken concrete slab into quarter sections without affecting the existing concrete surfaces surrounding the broken slab;

removing at least one broken concrete slab in four lifts or less from a space bounded by unaffected surrounding concrete surfaces;

transporting at least one replacement concrete slab having a uniformly planar top surface and a longitudinal axis to the space bounded by unaffected surrounding concrete surfaces;

placing at least one replacement concrete slab having a uniformly planar top surface into position above the space bounded by unaffected surrounding concrete surfaces;

guiding at least one replacement concrete slab having a uniformly planar top surface into the space bounded by unaffected surrounding concrete surfaces;

injecting fluid binding material between the roadbed and at least one replacement slab;

controlling replacement slab uplift during fluid binding material injection; and ensuring planar uniformity between at least one replacement slab uniformly planar top surface and the planar surfaces of unaffected surrounding concrete surfaces.

51. A method of cutting at least one broken concrete slab into quarter sections without affecting the existing concrete surfaces surrounding the broken slab according to claim 50 including:

providing cutting means selected from the group consisting of at least one: circular saw means, laser saw means, and water jet saw means;

providing global positioning control means for controllably directing cutting action of each saw;

providing bar code means for identifying at least one cut slab and locating its position within the roadway using global positioning means; and providing microprocessor means for recording the global positioning coordinates and bar code identification of at least one cut slab before it is removed from a space bounded by unaffected surrounding concrete surfaces.

52. The method of removing at least one broken concrete slab in four lifts or less according to claim 50 including:

providing a plate of solid material comprising a predetermined geometry, uniform thickness, plate edge boundaries, a planar plate top surface and a planar plate bottom surface, wherein the plate can support weights up to five tons;

providing a plurality of holes of uniform diameter through the plate, wherein each hole diameter defines a centerline perpendicular to the plate planar top and bottom surfaces;

providing a plurality of crane pick points on the plate edge boundaries;

providing means for anchoring the plate bottom planar surface flush to the top planar surface of at least one broken concrete slab quarter section through the plate holes;

providing crane lifting means joined to crane pick points.

53. The method of transporting at least one replacement concrete slab having a uniformly planar top surface and a longitudinal axis to the space bounded by unaffected surrounding concrete surfaces according to claim 52 including:

providing a frame capable of supporting replacement concrete slabs weighing approximately 25,000 pounds and having a longitudinal frame axis, comprising a front frame member having a top portion and bottom portion, a rear frame member having a top portion and a bottom portion, and a main support beam member connecting the front frame member and rear frame member by attachment to the top frame member portions, wherein the support beam comprises a top surface, a bottom surface, and two side surfaces;

providing wheel mounting members pivotally joined to the front frame member bottom portion;

providing wheel mounting members fixedly joined to the rear frame member bottom portion;

providing a tongue projecting forward from and joined to the wheel mounting members connected to the front frame member bottom portion;

providing wheels rotatably disposed on the wheel mounting members; and providing means to rotate, lower and raise, and fixedly secure at least one replacement concrete slab within the frame.

54. The method of placing at least one replacement concrete slab having a uniformly planar top surface into position above the space bounded by unaffected surrounding concrete surfaces according to claim 53 including:

providing at least one replacement concrete slab comprising a planar top surface of rectangular geometry defining slab side boundary edges, four corners, a predetermined uniform thickness, a predetermined length dimension, a predetermined width dimension, and means to identify the replacement slab with respect to placement of the replacement slab within existing concrete surface;

providing a plurality of adjustable and detachable slab collar members surrounding the slab side boundary edges wherein each collar member further comprises at least one injection port;

providing adjustable and detachable slab collar members surrounding the slab corners;

providing rectangular carrier plate geometry comprising, four corners, a predetermined uniform thickness, a predetermined length dimension which is slightly longer than the length of the replacement slab, and a predetermined width dimension which is slightly shorter than the width of the replacement slab;

providing means to fixedly attach adjustable and detachable slab collar members surrounding the slab side boundary edges to the carrier plate;

providing means to fixedly attach adjustable and detachable slab collar members surrounding the slab corners to the means to fixedly attach adjustable and detachable slab collar members surrounding the slab side boundary edges to the carrier plate; and providing global satellite positioning control means to position the carrier plate.

55. The method of guiding at least one replacement concrete slab having a uniformly planar top surface into the space bounded by unaffected surrounding concrete surfaces according to claim 54 including:

providing four uniform collars each comprising a top surface of predetermined width having a longitudinal axis, inside and outside surfaces of predetermined height which end at a tapered squared-off collar bottom, a cross-sectional geometry defining a vertical side attached at right angles to the top and bottom sides which join a tapered side, a plurality of extension arms equidistantly spaced along the collar inside surfaces extending inwards from the surfaces perpendicular to the collar longitudinal axis, wherein two longer collars have uniform lengths slightly shorter than corresponding replacement slab length dimension, and wherein the other two shorter collars have uniform lengths slightly shorter than corresponding replacement slab width dimension;

providing two uniform slot bars fixedly attached to the carrier plate top side, parallel to the carrier plate long side, and comprising a plurality of slots sized to receive and hold collar extension arms so that the longer collar inside surfaces communicate with the replacement slab length boundaries, wherein one slot bar is set at a predetermined distance from one carrier plate long side and the other slot bar is set at an equal distance from the other carrier plate long side;

providing two uniform sets of a plurality of slots in carrier plate short sides, wherein each slot has uniform cross-sectional geometries defining a slot centerline, wherein each set of slots comprises the same number of slots on each carrier plate short side, wherein slot center-lines are perpendicular to the carrier plate short side, wherein the alignment of slot center-lines on the carrier plate short side are equidistant and linear, and wherein the slots are sized to receive and hold collar extension arms so that the shorter collar inside surfaces communicate with the replacement slab width boundaries;

providing means for bar code identification of at least one replacement slab stored in means for microprocessor data storage and access;

providing means for correlation of bar code identification for at least one replacement slab with global satellite positioning coordinates for the broken concrete slab removed from a space bounded by unaffected surrounding concrete surfaces by microprocessor means; and providing wireless transmission means to communicate a plurality of data selected from the group consisting of at least: bar code identification for at least one replacement slab and global satellite positioning coordinates for positioning the replacement slab into the space vacated by the removed broken concrete slab, to means for guiding at least one replacement concrete slab into the space bounded by unaffected surrounding concrete surfaces.

56. The method of injecting fluid binding material between the roadbed and at least one replacement slab according to claim 55 including:

providing at least one replacement slab with a bottom surface comprising precast flow channels, at least one injection port on the slab top surface through the slab thickness and exiting on the slab bottom surface within a flow channel;

providing four corner collars bridging the space between shorter and longer collars on the replacement plate corners; and providing at least one injection port in a replacement slab collar member.

57. The method of controlling replacement slab uplift during fluid binding material injection and ensuring planar uniformity between at least one replacement slab uniformly planar top surface and the planar surfaces of unaffected surrounding concrete surfaces according to claim 56 including:

providing at least one bridge plate of solid material comprising a predetermined geometry, uniform thickness, a planar plate top surface, a planar plate bottom surface, and a plurality of slots through the bridge plate, wherein the bridge plate bottom surface can be fixedly attached to a replacement slab top surface positioned in the space bounded by unaffected surrounding concrete surfaces with a portion of the bridge plate planer bottom surface extending to and communicating with unaffected surrounding concrete surfaces;

providing attachment means whereby at least one bridge plate bottom surface can be fixedly attached to a replacement slab top surface positioned in the space bounded by unaffected surrounding concrete surfaces through the slots through the bridge plate; and providing at least one support weight affixed to the bridge plate top surface corresponding to the bridge plate planer bottom surface extending to and communicating with unaffected surrounding concrete surfaces.

* * * * *